US010704821B2

(12) United States Patent
Sigety et al.

(10) Patent No.: US 10,704,821 B2
(45) **Date of Patent: *Jul. 7, 2020**

(54) METHODS, APPARATUSES, AND SYSTEMS FOR COOLING

(71) Applicant: Fresh Chill Solutions, Inc., Tampa, FL (US)

(72) Inventors: Charles Birge Sigety, Tampa, FL (US); Katharine Colyer Sigety, Tampa, FL (US); William DeWitt, Dunedin, FL (US)

(73) Assignee: Fresh Chill Solutions, Inc., Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/977,113

(22) Filed: May 11, 2018

(65) Prior Publication Data

US 2018/0259237 A1 Sep. 13, 2018

Related U.S. Application Data

(63) Continuation of application No. 15/462,469, filed on Mar. 17, 2017, now Pat. No. 9,995,524.

(Continued)

(51) Int. Cl.

*F25D 11/00* (2006.01)
*F25D 17/06* (2006.01)

(Continued)

(52) U.S. Cl.

CPC ..... *F25D 11/003* (2013.01); *F25D 13/06* (2013.01); *F25D 17/06* (2013.01); *F25D 17/067* (2013.01);

(Continued)

(58) Field of Classification Search

CPC ..... F25D 11/003; F25D 25/04; F25D 29/00; F25D 17/067; F25D 23/021; F25D 2400/38; F25D 2400/28; F25D 2700/16

See application file for complete search history.

(56) References Cited

U.S. PATENT DOCUMENTS 4,532,774 A 8/1985 Burns
5,899,084 A 5/1999 Franaszek et al.

(Continued)

FOREIGN PATENT DOCUMENTS

JP S60203137 A 10/1985
JP H09113093 A 5/1997
WO 2011/050157 4/2011

OTHER PUBLICATIONS

Yamashita, Continuous Preliminary Cooling Process . . . , Oct. 14, 1985, JPS60203137A, Whole Document (Year: 1985).*

*Primary Examiner* — Larry L Furdge

(74) *Attorney, Agent, or Firm* — Raymond R. Ferrera; Adams and Reese LLP

(57) ABSTRACT

Embodiments of the present disclosure include methods, apparatuses, and systems for cooling. Embodiments include a cooling system comprising a mobile container, conveyor system, and sensor feedback system. Container includes at least a first, second, and third section. First section holds at least one pallet containing produce. Second section includes a cooling mechanism to cool the produce within the at least one pallet to an optimal temperature. Third section includes the cooling mechanism to maintain the cooled produce in the at least one pallet at the optimal temperature. Conveyor system may be used to convey the at least one pallet across the cooling system. Sensor feedback system is configured to continuously measure and track at least the weight of the at (Continued)

least one pallet and temperature of the produce within the at least one pallet as the at least one pallet is conveyed across the cooling system.

31 Claims, 27 Drawing Sheets

Related U.S. Application Data

(60) Provisional application No. 62/309,886, filed on Mar. 17, 2016.

(51) Int. Cl.

| | |
|---|---|
| ***F25D 29/00*** | (2006.01) |
| ***F25D 23/02*** | (2006.01) |
| ***F25D 25/04*** | (2006.01) |
| ***F25D 13/06*** | (2006.01) |

(52) U.S. Cl.

CPC ..... *F25D 23/021* (2013.01); *F25D 25/04* (2013.01); *F25D 29/00* (2013.01); *F25D 29/003* (2013.01); *F25D 2317/067* (2013.01); *F25D 2400/28* (2013.01); *F25D 2400/38* (2013.01); *F25D 2700/08* (2013.01); *F25D 2700/16* (2013.01)

(56) References Cited

U.S. PATENT DOCUMENTS

| | | | |
|---|---|---|---|
| 6,922,652 | B2 | 7/2005 | Edwards et al. |
| 2005/0108920 | A1 | 5/2005 | Takenoshita et al. |
| 2007/0017233 | A1 | 1/2007 | Hawkins |
| 2009/0142154 | A1 | 6/2009 | Hammond |
| 2009/0228155 | A1 | 9/2009 | Slifkin et al. |
| 2011/0138820 | A1 | 6/2011 | Weeth et al. |
| 2014/0345304 | A1 | 11/2014 | Leung et al. |

* cited by examiner

METHODS, APPARATUSES, AND SYSTEMS FOR COOLING

This application is a continuation of U.S. patent application Ser. No. 15/462,469, filed Mar. 17, 2017, which claims the benefit of U.S. Provisional Patent Application No. 62/309,886, filed Mar. 17, 2016, each of which is incorporated herein by reference.

DESCRIPTION OF EMBODIMENTS

Figure 1:
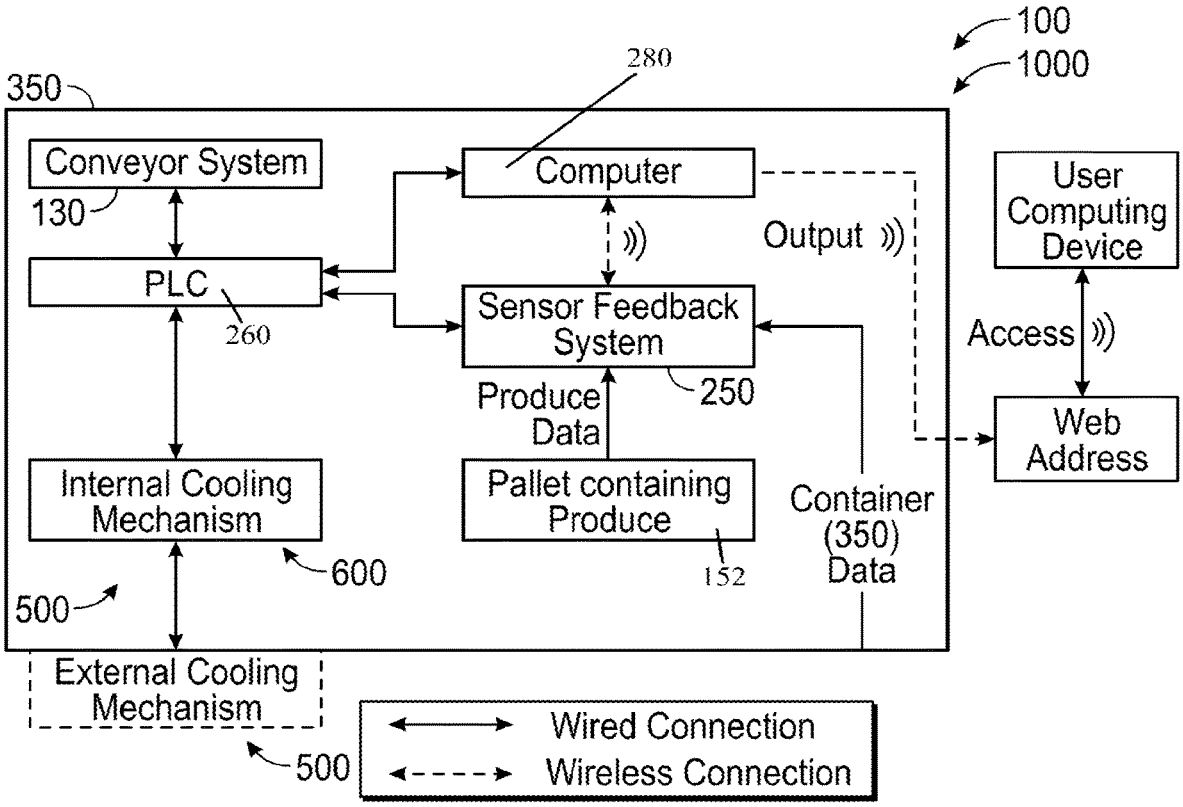
FIG. 1 is a schematic of a cooling system, according to an exemplary embodiment of the present disclosure.

Produce begins to ripen and/or spoil as soon as it is harvested. Cooling the produce immediately and rapidly after harvesting slows this ripening and/or spoilage. Existing cooling systems for produce are slower than desired and have led to decreased overall shelf life of the produce.

In some cooling systems, workers in the field may pack the produce in produce containers, such as cartons, trays or boxes, that are then stacked on pallets and transferred via a flatbed truck or other transportation to a distribution point. At this distribution point, the cartons may be placed in a large refrigerated building to cool the produce as quickly as possible. Other systems for cooling produce are disclosed in U.S. Pat. Nos. 5,992,169, 5,375,431, and 5,386,703. These systems disclose apparatuses and methods for cooling produce via the use of vacuum chambers/pumps and hydro cooling.

Methods, apparatuses, and systems are provided for cooling produce via a cooling system. Embodiments include a cooling system having: a mobile container/trailer with separated sections to continuously cool produce to, and maintain the produce at, an optimal temperature; a conveyor system to convey produce across the sections of the mobile container; and a sensor feedback system to continuously measure, track, and receive relevant feedback/data regarding the produce. The sensor feedback system may be a dynamic real-time feedback system allowing a user to ensure that the produce is being cooled to an optimal temperature prior to being processed.

In exemplary embodiments, relevant data (e.g., weight, temperature) regarding the produce may be continuously measured, tracked, displayed to a user, and/or stored in a database (locally and/or in the cloud). Importantly, this data may be obtained, tracked, and stored from as early as the point of harvest of the produce, at various points during cooling of the produce via the cooling system, and all the way up the supply chain to a distribution center, grocery store, and eventually, the customer.

Embodiments of the cooling system may include cooling mechanisms integrated within and/or attached to a mobile container/trailer that may be easily moved to different locations. As such, the cooling system may be mobile and brought directly to fresh produce during or right after harvesting. The result is optimized on-site cooling leading to longer shelf life for produce. The system also results in reduced costs associated with handling and decreased time to market—all leading to fresher produce and substantial cost savings.

The inventions disclosed herein include a system for cooling produce. One embodiment of a system for cooling produce comprises a mobile container having a plurality of cooling stations therein. The mobile container has an input opening on a first end and an output opening on an opposing end thereof. The input and output openings are configured to receive produce containers therethrough. The mobile container has a staging section adjacent the input opening for receiving produce containers conveyed through the input opening. The staging section provides a cooled environment for initial cooling of produce. A rapid cooling section has first, second, and third cooling stations. The first cooling station is positioned to receive produce containers conveyed from the staging section, and has an associated cooling mechanism for cooling produce in the first cooling station. The second cooling station is positioned to receive produce containers conveyed from the first cooling station, and has an associated cooling mechanism for cooling produce in the second cooling station. The third cooling station is positioned to receive produce containers conveyed from the second cooling station, and has an associated cooling mechanism for cooling produce in the third cooling station.

The first, second and third cooling stations together sequentially cooling produce to an optimal temperature by at least the third cooling station. A discharge section is positioned to receive produce containers conveyed from the third cooling station of the rapid cooling section and maintain produce at the optimal temperature. The discharge station is configured to convey produce containers out of the mobile container through the output opening.

The system can be provided with a conveyor system in the mobile container for conveying produce containers from the input end to the output end to thereby sequentially transport produce containers through the staging, rapid cooling and discharge sections. A plurality of doors can be provided, the doors positioned to selectively close and thereby retain cold air for circulation within each of the first cooling station, the second cooling station, and the third cooling station during cooling of produce. Each of the plurality of doors can be an automatic roll-up door.

In some embodiments, the cooling mechanism in the first, second, and third cooling stations includes chilled air outputted via cooling fans and coils located on a first side of each of the first, second, and third cooling stations to thereby force chilled air over produce. Air is internally recirculated via return air ducts and fans located on an opposing second side of each of the first, second, and third cooling stations back to the cooling fans and coils located on the first side.

A sensor feedback system can be provided that is configured to continuously measure and track temperature of produce as produce containers are conveyed through the system. The sensor feedback system can be a dynamic real-time sensor feedback system. The sensor feedback system can be configured to measure and track the weight of produce as produce containers are conveyed through the system. In some embodiments, the sensor feedback system includes at least a first sensor integrated with the conveyor system, which is used to measure weight of at least one pallet upon entering the system, and a second sensor placed within the at least one pallet, which is used to measure the temperature of produce within the at least one pallet. The first and second sensors send at least one of weight and temperature information to a PLC device. The PLC device obtains at least the weight and temperature information of the produce and sends the weight and temperature information to at least one of a local storage and a cloud-based database. The sensor feedback system can include sensors mounted within the container that allow a user to determine the location of the at least one pallet in the cooling system. The PLC device can be connected to and control at least one of the cooling mechanism, conveyor system, and sensor feedback system.

Methods of cooling produce are also provided. One method of cooling produce comprise inserting at least one pallet containing produce into a cooling system. The cooling system includes a mobile container including at least a separated first, second, and third section. The first section holds the at least one pallet containing produce in a semi-cooled environment. The second section includes a cooling mechanism to cool the produce within the at least one pallet to an optimal temperature. The third section includes the cooling mechanism to maintain cooled produce in the at least one pallet at the optimal temperature. A conveyor system is provided, the convey system including at least one conveyor longitudinally extending along the length of the mobile container. The conveyor system is used to convey the at least one pallet from the first section to each of the second and third sections. A sensor feedback system is configured to continuously measure and track at least the weight of the at least one pallet and temperature of the produce within the at least one pallet as the at least one pallet is conveyed across the cooling system. The method includes transporting the produce from the first section to the second section via the conveyor system; cooling the produce within the at least one pallet to the optimal temperature via the cooling mechanism; continuously measuring and tracking at least the weight and temperature of the produce within the at least one pallet via the sensor feedback system while conveying the at least one pallet along the second section to ensure the produce remains at the optimal temperature; transporting the produce from the second section to the third section via the conveyor system; and maintaining the produce within the at least one pallet at the optimal temperature.

In some embodiments, the second section includes a first cooling station, a second cooling station, and a third cooling station, each of which is configured to hold at the least one pallet being conveyed across the system. The cooling mechanism in the first, second, and third cooling stations can include chilled air outputted via vents located on a first side of the container to cool produce in the at least one pallet, with heat from the produce being exhausted out via vents located on an opposing second side of the container. In some embodiments, the cooling mechanism in the first, second, and third cooling stations includes chilled air outputted via cooling fans and coils located on a first side of each of the first, second, and third cooling stations to cool produce in the at least one pallet, with heat from the produce being internally recirculated via return air ducts and fans located on an opposing second side of each of the first, second, and third cooling stations back to the cooling fans and coils located on the first side.

In some embodiments, the sensor feedback system includes at least a first sensor integrated with the conveyor system, which is used to measure weight of the at least one pallet upon entering the system, and a second sensor placed within the at least one pallet, which is used to measure the temperature of the produce within the at least one pallet. The sensor feedback system can include sensors mounted within the container that allow a user to determine the location of the at least one pallet in the cooling system.

In some embodiments, the system comprises a mobile container including a cooling mechanism, the mobile container having separated sections to continuously cool produce to, and maintain the produce at, an optimal temperature via the cooling mechanism; a conveyor system to convey produce across the separated sections of the container; and a sensor feedback system to continuously measure, track, and store relevant information regarding the produce being conveyed across the container, and to control the movement of the conveyor system based on this information. The cooling mechanism can include an external cooling mechanism that interacts with an internal cooling mechanism installed within the container to cool the produce. The cooling mechanism can be an entirely internal cooling mechanism installed within the container.

In some embodiments, the system for cooling produce comprises a mobile container having an input opening on a first end and an output opening on an opposing end thereof. The input and output openings are configured to receive produce containers therethrough. The mobile container has a staging section adjacent the input opening for receiving produce containers conveyed through the input opening. The staging section provides a cooled environment for initial cooling of produce. The system includes a rapid cooling section configured for cooling produce to an optimal temperature. A discharge section is positioned to receive produce containers conveyed from the rapid cooling section and maintain produce at the optimal temperature. The discharge station is configured to convey produce containers out of the mobile container through the output opening. The rapid cooling section can comprise: a first cooling station positioned to receive produce containers conveyed from the staging section, the first cooling station having an associated cooling mechanism for cooling produce in the first cooling station; a second cooling station positioned to receive produce containers conveyed from the first cooling station, the second cooling station having an associated cooling mechanism for cooling produce in the second cooling station; and a third cooling station positioned to receive produce containers conveyed from the second cooling station, the third cooling station having an associated cooling mechanism for cooling produce in the third cooling station. The first, second and third cooling stations together sequentially cool produce to the optimal temperature by at least the third cooling station.

In some embodiments a conveyor system is provided in the mobile container for conveying produce containers from the input end to the output end to thereby sequentially transport produce containers through the staging, rapid cooling and discharge sections. In some embodiments, the conveyor system includes at least seven conveyors extending along each of the first section, second section, and third section of the container. A plurality of doors can be provided, the doors positioned to selectively close and thereby retain cold air for circulation within each of the first cooling station, the second cooling station, and the third cooling station during cooling of produce. The doors can be automatic roll-up doors. In some embodiments, the mobile container is fixed on a wheeled trailer chassis for use in moving the mobile container.

In some embodiments, the cooling mechanism in the first, second, and third cooling stations includes chilled air outputted via vents located on a first side of the container to flow chilled air over produce and then into exhaust vents located on an opposing second side of the container. In some embodiments, the cooling mechanism in the first, second, and third cooling stations includes chilled air outputted via cooling fans and coils located on a first side of each of the first, second, and third cooling stations to thereby force chilled air over produce, with air being internally recirculated via return air ducts and fans located on an opposing second side of each of the first, second, and third cooling stations back to the cooling fans and coils located on the first side. The cooling mechanism in the third section can include chilled air outputted via vents located on opposing sides of the container to thereby force chilled air over produce from opposing sides.

Figure 2:
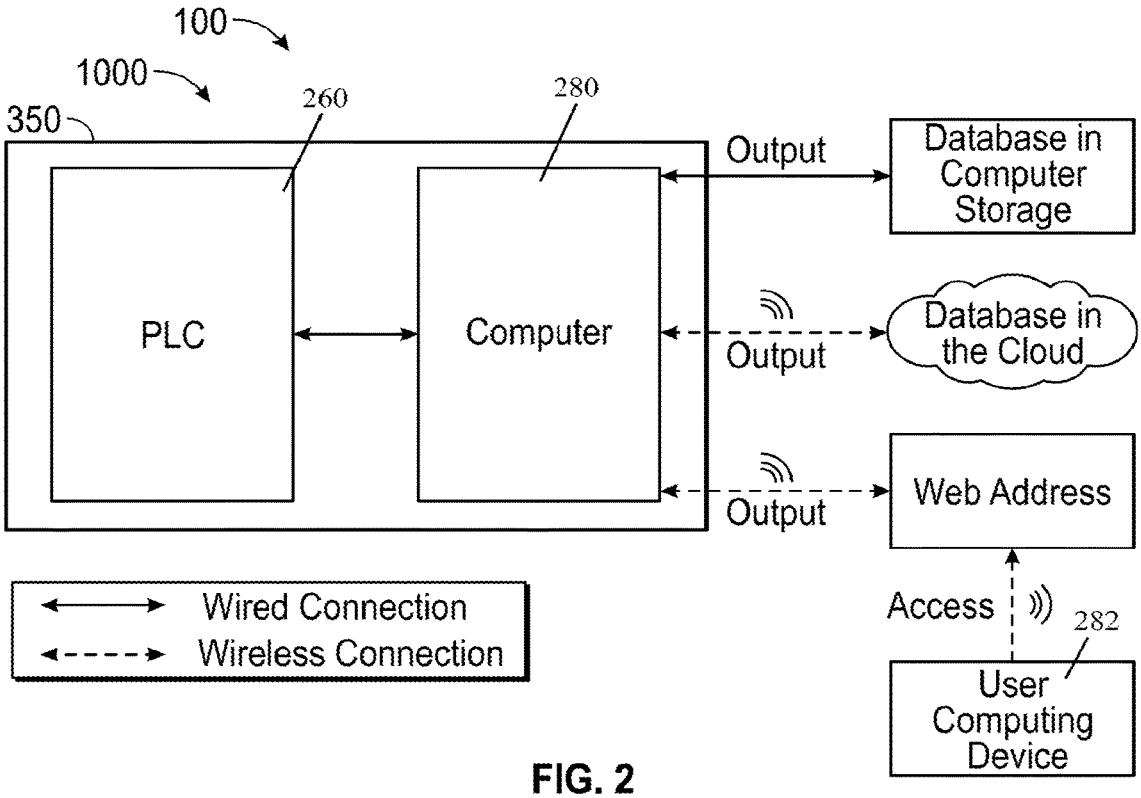
FIG. 2 is a schematic of a cooling system, according to an exemplary embodiment of the present disclosure.

Referring to FIG. 1, a schematic of cooling systems 100, 1000 is shown. FIG. 2 is a schematic showing cooling systems 100, 1000 in communication with local and cloud-based databases.

Cooling systems 100, 1000 may include sensor feedback system 250, conveyor system 130, and computer 280, each located in a mobile container 350 and each interconnected together and connected to and controlled by a Programmable Logic Controller (PLC) 260 mounted within container 350 via hard wired and wireless connections. Sensor feedback system 350 may be used to obtain relevant data from produce, from produce containers 150, such as pallets 150, containing produce, and from mobile container 350, and send the data to computer. Computer 280 may continuously receive this data and output the data to a web address/user interface 282 accessible by a user from any user computing device, and/or to local or cloud-based databases. See FIGS. 1 and 2.

The relevant data being received and stored in the database may include but is not limited to: type of produce, important properties of the produce (e.g., weight, temperature), date of harvest of produce, location of the farm where the produce was harvested, specific location of the produce in the farm at the point of harvest, etc.

In one embodiment, cooling system 100 may include an internal-external cooling mechanism 500 installed within, and/or attached to exterior of, mobile container 350, respectively.

In an alternative embodiment, cooling system 1000 may include only an internal cooling mechanism 600 installed within mobile container 350.

Cooling systems 100, 1000, sensor feedback system 250, cooling mechanisms 500, 600, conveyor system 130, and computer shown in FIGS. 1 and 2 may be implemented using the apparatuses, systems and methods further described herein, including various embodiments thereof.

PLC or other suitable controller/control technologies may be configured to convert user input signals from a user interface device 282 connected to the PLC 260 into control signals for controlling components of systems 100, 1000. User interface device may be for e.g. a computing device such as a mobile device (smart phone; smart tablet, etc.).

In embodiments, PLC may be mounted within container 350. In a particular embodiment, PLC may be located in a control panel/electrical panel between ductwork of container 350 and a sidewall of container 350. In other embodiments, PLC may be located external to systems 100, 1000 and remotely control components within systems 100, 1000. Connection between the PLC and user interface device may be any wireless connection such as RF, infrared, or any other suitable communication technology. In an exemplary embodiment, PLC may be an Allen-Bradley CompactLogix™ 5370 controller (1769-L18ERM-BB1B).

PLC may be configured to connect and deliver control signals to systems 100, 1000 to control components of systems 100, 1000, including cooling mechanisms 500, 600, conveyor system 130, and/or sensor feedback system 250 described herein. For e.g., PLC may deliver control signals to motors 132 attached to conveyor system 130 to control speed of conveyor system 130. Further, in an embodiment, PLC may connect and deliver output signals to external cooling mechanisms such as refrigeration equipment to perform cooling mechanism in system 100. User input signals and control signals may be either digital or analog, and the PLC or other suitable controller may be configured to accept and/or output either. In some embodiments, PLC may accept information regarding produce from a wired RFID (radiofrequency identification) reader. In other embodiments, an electrical box including an industrial computer 280 connected to a wireless receiver may be wired to the PLC, which computer may wirelessly collect and/or transmit information regarding produce. See, e.g., FIG. 1.

Cooling systems 100, 1000 of the present disclosure may include any communications via bluetooth, Wi-Fi, hard wire internet, cell phone signal, and/or satellite signal, depending on the application.

Figure 3B:
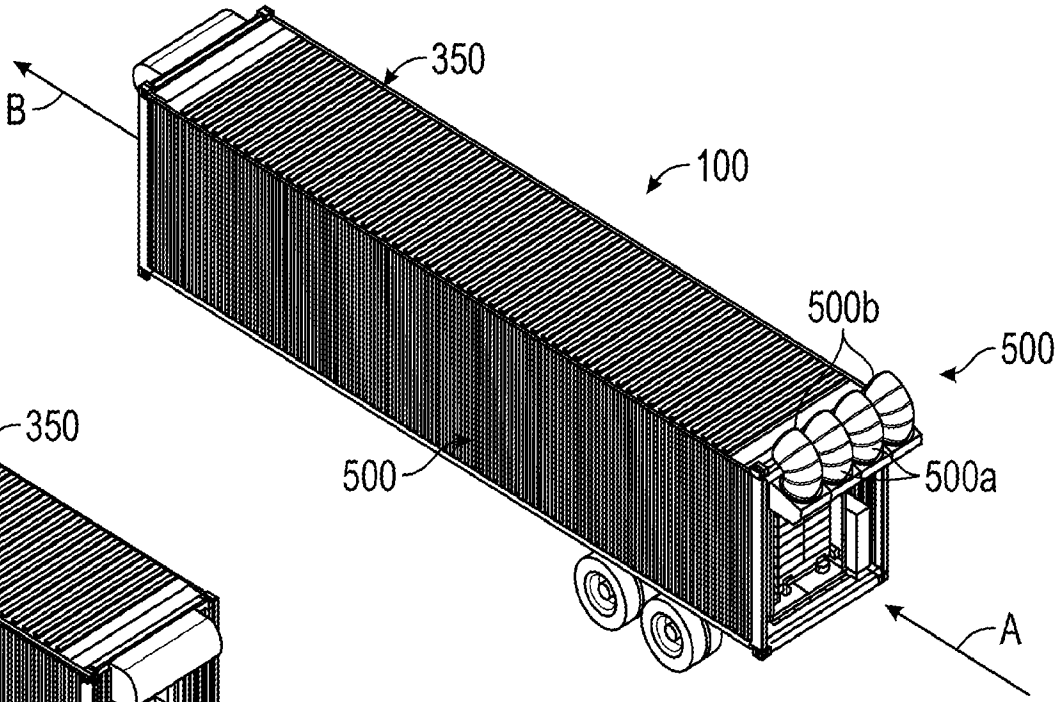
FIG. 3B is a rear isometric view of the cooling system shown in FIG. 3A.
Figure 3A:
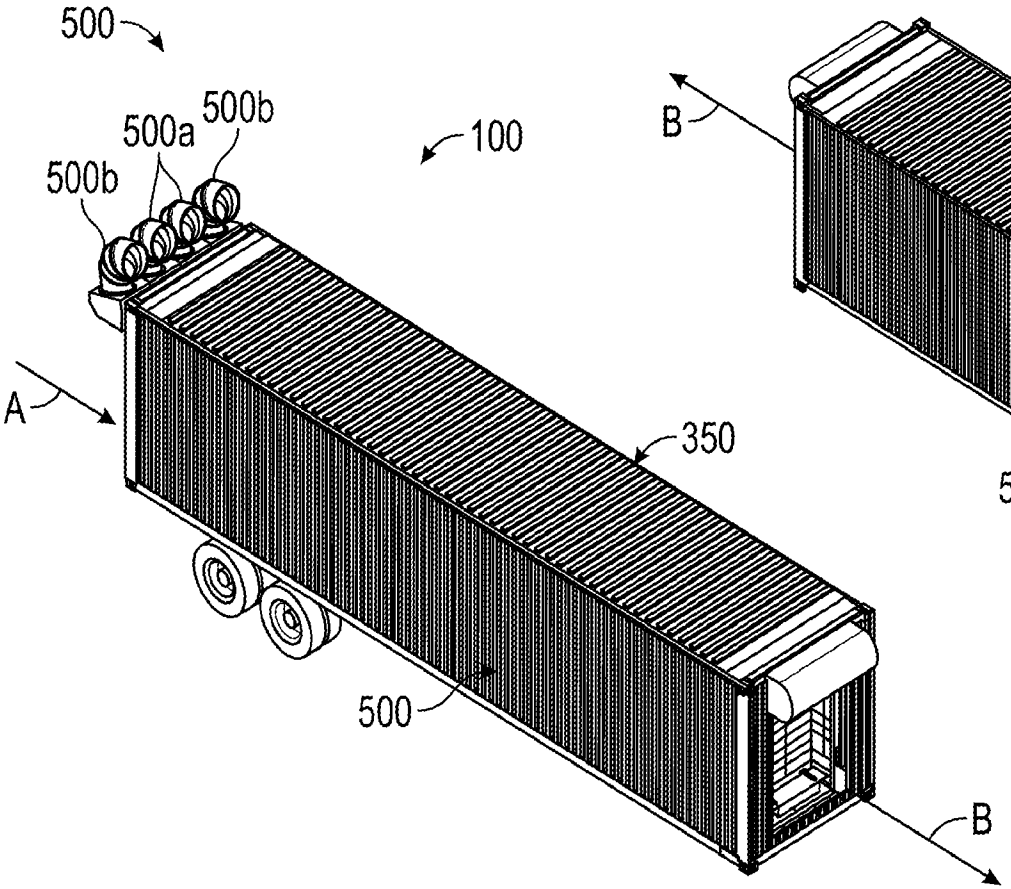
FIG. 3A is a front isometric view of a cooling system, according to an exemplary embodiment of the present disclosure.
Figure 4:
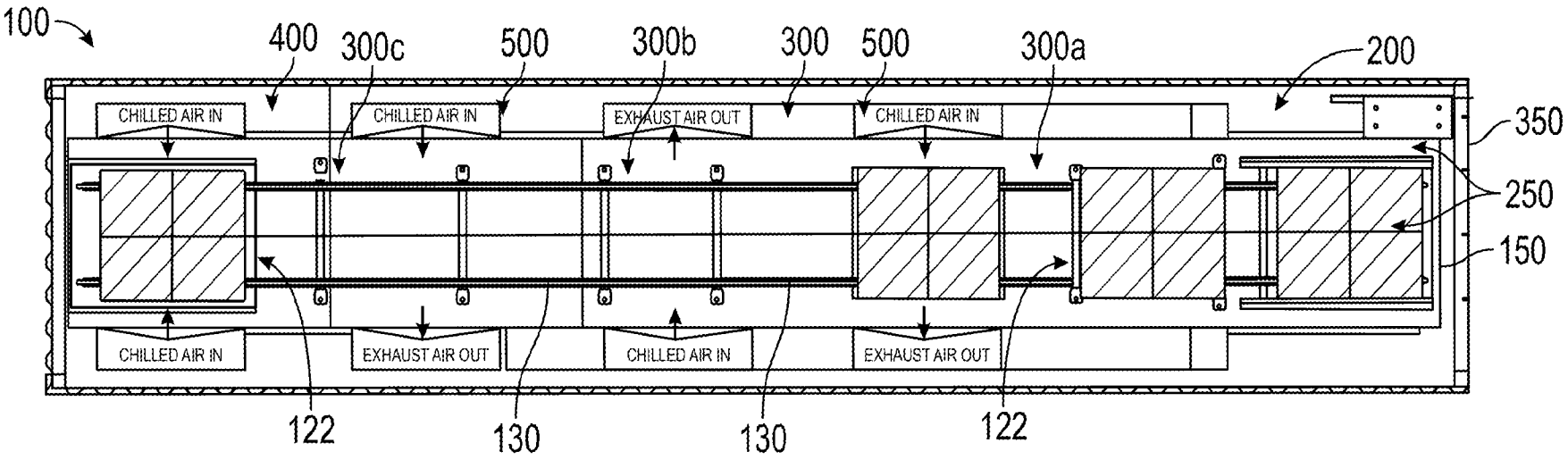
FIG. 4 is a top internal view of a cooling system, according to an exemplary embodiment of the present disclosure.
Figure 5:
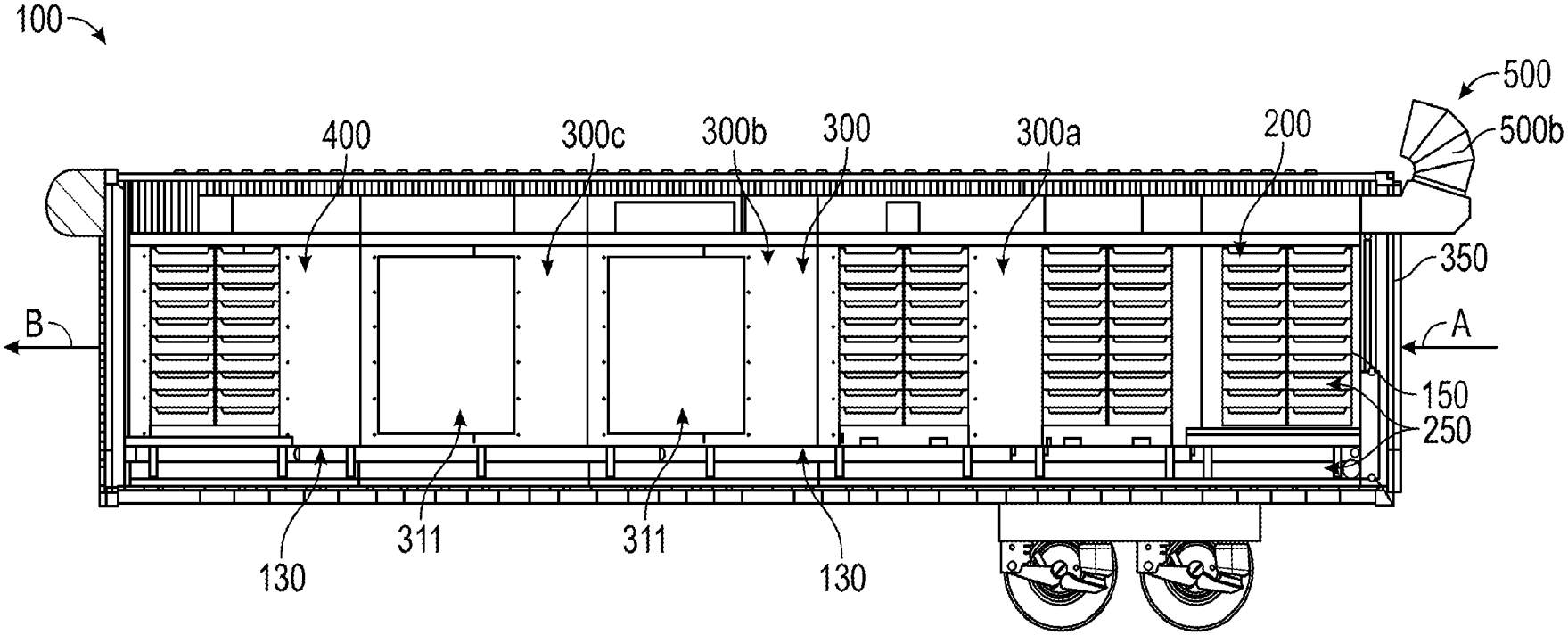
FIG. 5 is a side cross-sectional view of an interior of a cooling system, according to an exemplary embodiment of the present disclosure.

Referring to FIGS. 3A to 5, different views of cooling system 100 are shown. FIG. 3A is a front isometric view of cooling system 100. FIG. 3B is a rear isometric view of cooling system 100. FIG. 4 is a top internal view of cooling system 100. FIG. 5 is a side cross-sectional view of an interior of cooling system 100.

Cooling system 100 may be a container/trailer attached to a trailer chassis. See, e.g., FIGS. 3A, 3B, and 5. In exemplary embodiments, cooling container/trailer 350 may be approximately thirty five to forty feet long. In some embodiments, container 350 may include a hard ground cover to hold an approximately 60,000 lb mobile cooling container attached to a trailer chassis. However, cooling system 100 is not limited to this particular configuration, and containers and/or trailers of other suitable sizes/lengths/widths may be used in embodiments of the present disclosure.

Figure 7:
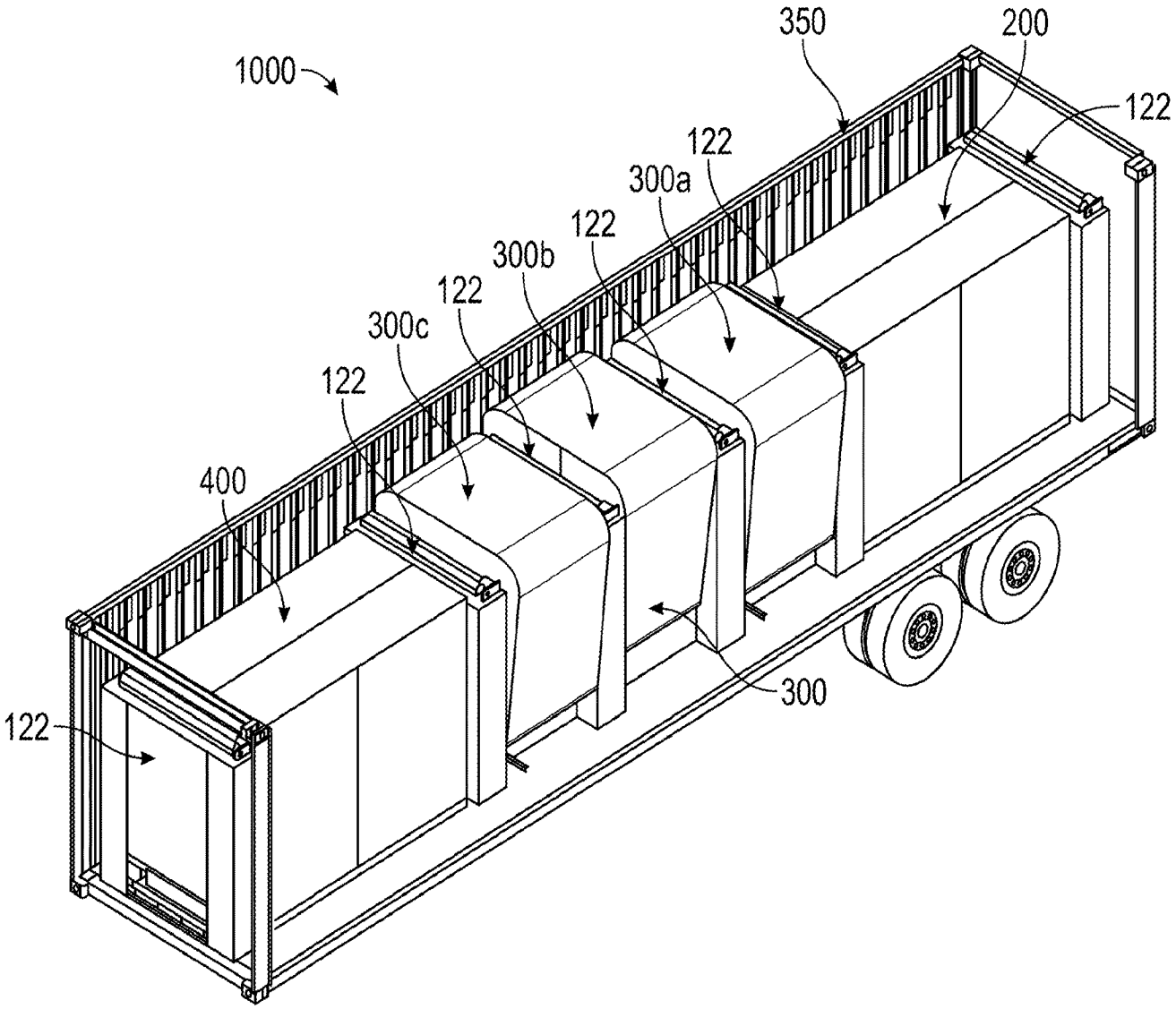
FIG. 7 is a front isometric view of a cooling system, according to an exemplary embodiment of the present disclosure.

As indicated in FIG. 7, in particular embodiments, container 350 may include stainless steel airtight sections/chambers 200, 300 (300*a*, 300*b*, 300*c*), 400 dragged into and bolted within container 350. In this embodiment, gaskets may be used to seal each section with each other. Further, insulation may be installed between the outside of each steel section and an exterior cladding of the mobile container 350. Tracks may be positioned on opposing sides of each steel section to assist in insertion and installation of each section. In other embodiments, cooling container 350 may be a box/chamber that is inserted and bolted into a standard reefer/box trailer or placed onto a flat deck trailer, such that produce packed in, for e.g. palletized lugs, may be placed into the unit 350 for cooling. For e.g., container 350 may be fit into a fifty-three-foot long reefer trailer. In yet other embodiments, container 350 may be "Intermodal", and designed to be moved from one mode of transport to another (e.g. from ship, to rail, to truck).

In some embodiments, cooling system 100 may be integrated into existing harvesting systems, packaging systems, and/or a building or other structure for further refrigeration, packaging, and processing. In an exemplary embodiment, harvesting system may be an Oxbo 7420 harvester that can output at least three pallets 150 of produce every forty-five minutes. In other embodiments, cooling system 100 may be integrated into a semi-trailer system to act as a "factory in the field" that performs harvesting, processing, cooling, and/or packaging of produce at one location.

Cooling container/trailer 350 may include an opening in a front and back end 351, 352 of the container 350 to allow for insertion and removal of produce packed in, for e.g., palletized lugs/pallets 150. For e.g., one end opening of the cooling container 350 may include a dock seal built into a frame of the container 350, so that a standard reefer trailer, smaller field trailer, forklift, and/or similar structure may unload pallets 150 directly into the container 350 for cooling. An opposing end opening of the cooling container 350 may be configured to unload chilled produce 152 in pallets 150 directly onto, for e.g., a fresh fruit packing line, a refrigerated trailer, and/or an opening in a refrigerated building. In some embodiments, a protruding, airtight, rolling door 122 may be attached to this opposing end opening of container 350. See, e.g., FIG. 3A. In other embodiments, each end opening of the container 350 adjacent to door 122 may include a plate, trailer door, or other structure to cover up the opening during transport. End openings of container 350 may therefore allow for increased versatility and adaptability of system 100 to different types of processes.

Cooling system 100 may include connections/attachments to attach/plug in system 100 to various other systems, including but not limited to cooling systems, power systems, etc. For e.g., cooling container 350 may be powered via attachments to a variety of connections to back up different ton units. In a particular embodiment, container 350 may be powered via attachments to a three-phase power source that may be, for e.g., a landline or generator, as well as a 25+ ton refrigerator (Air Conditioning Unit) that integrates with a PLC mounted within the container 350.

Referring to FIGS. 4 and 5, cooling container/trailer 350 of cooling system 100 may include at least a separated first staging section 200, second rapid cooling section 300, and third discharge section 400. In an exemplary embodiment, first section 200, second section 300, and third section 400 may be made from stainless steel. However, first section 200, second section 300, and third section 400 may be made from other suitable materials, including any materials that can be cleaned and disinfected per applicable food processing rules and requirements.

As shown in FIG. 4, first section 200, second section 300, and third section 400 are separated via swinging doors 122 or roll-up doors 122. Swinging doors 122 may be configured to separate each of the first, second, and third sections 200, 300, 400, while simultaneously allowing at least one pallet 150 containing produce to be easily conveyed from the first section 200 to the second section 300 to the third section 400. Alternatively, first section 200, second section 300, and third section 400 may be separated via other suitable movable structures, e.g., flexible clear plastic flaps/doors or fabric rollup doors 122, to allow for produce to pass between the sections of container 350. In some embodiments, a rollup door 122 may be fitted with sensors that act to automatically open and shut the roll-up door 122 as at least one pallet 150 is conveyed across the system 100.

At least one pallet 150 containing produce may be successively conveyed from the first section 200 to the second and third sections 300, 400 of the container 350 via a conveyor system 130. See, e.g., FIG. 4. Conveyor system 130 may include at least one conveyor/movable belt 136 longitudinally extending along the length of the mobile container/trailer 350 and across the first section 200, second section 300, and third section 400. In an exemplary embodiment, conveyor system 130 may include a series of conveyors longitudinally extending along the entire length of the container 350/cooling system 100. In an embodiment, chain conveyors may be mounted inside a steel piping system within container 350. See, e.g., FIG. 4. Chain conveyors may vary in size and/or graduate into each other. As shown in FIG. 4, one conveyor may be located in first section 200, three conveyors may be located in second section 300, and one conveyor may be located in third section 400. In an alternative embodiment, conveyor system 130 may include at least seven five foot long conveyors extending along each of the first section 200, second section 300, and third section 400 of the container 350.

Figure 16:
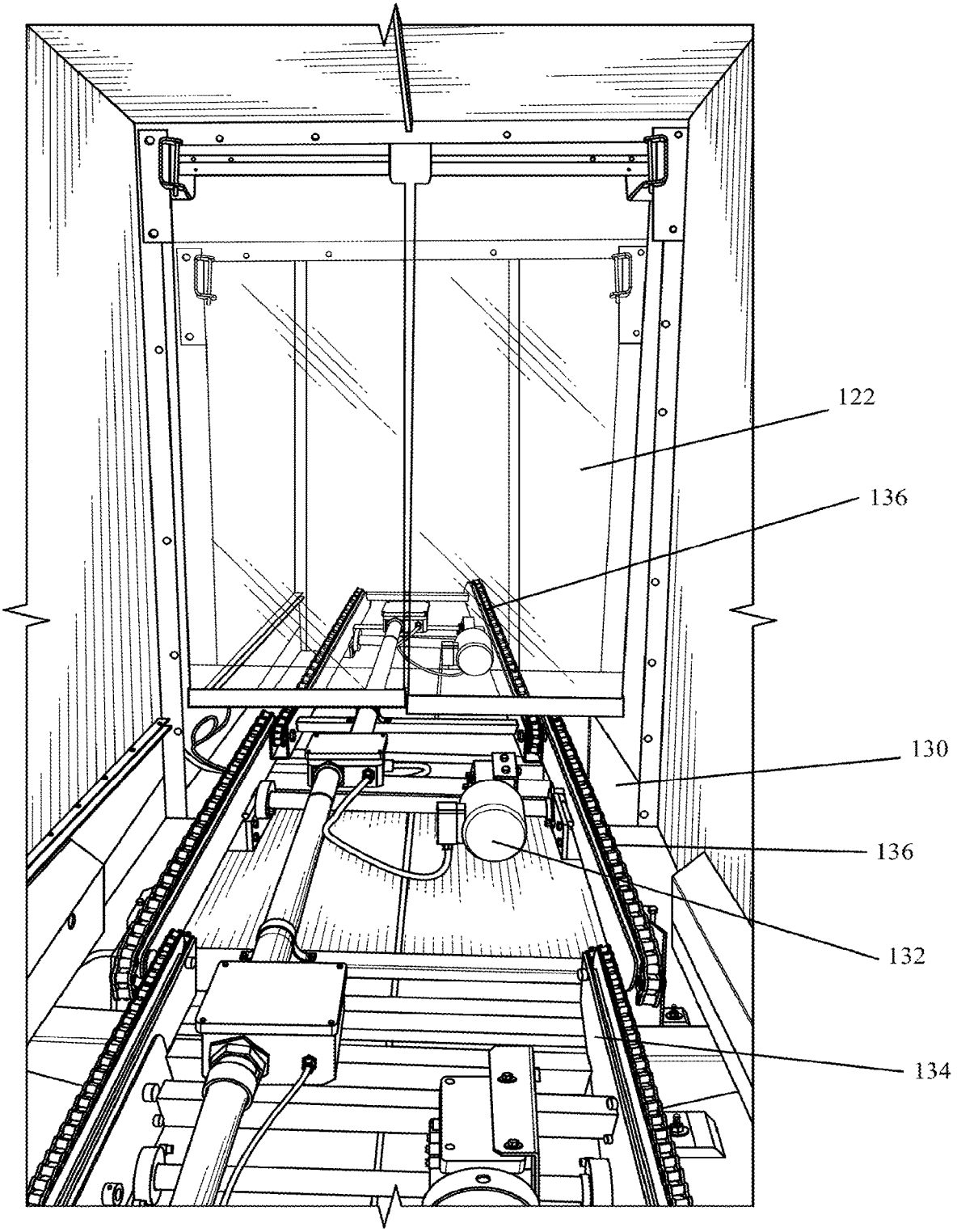
FIG. 16 is an internal view featuring aspects of a conveyor system of the present disclosure.
Figure 17:
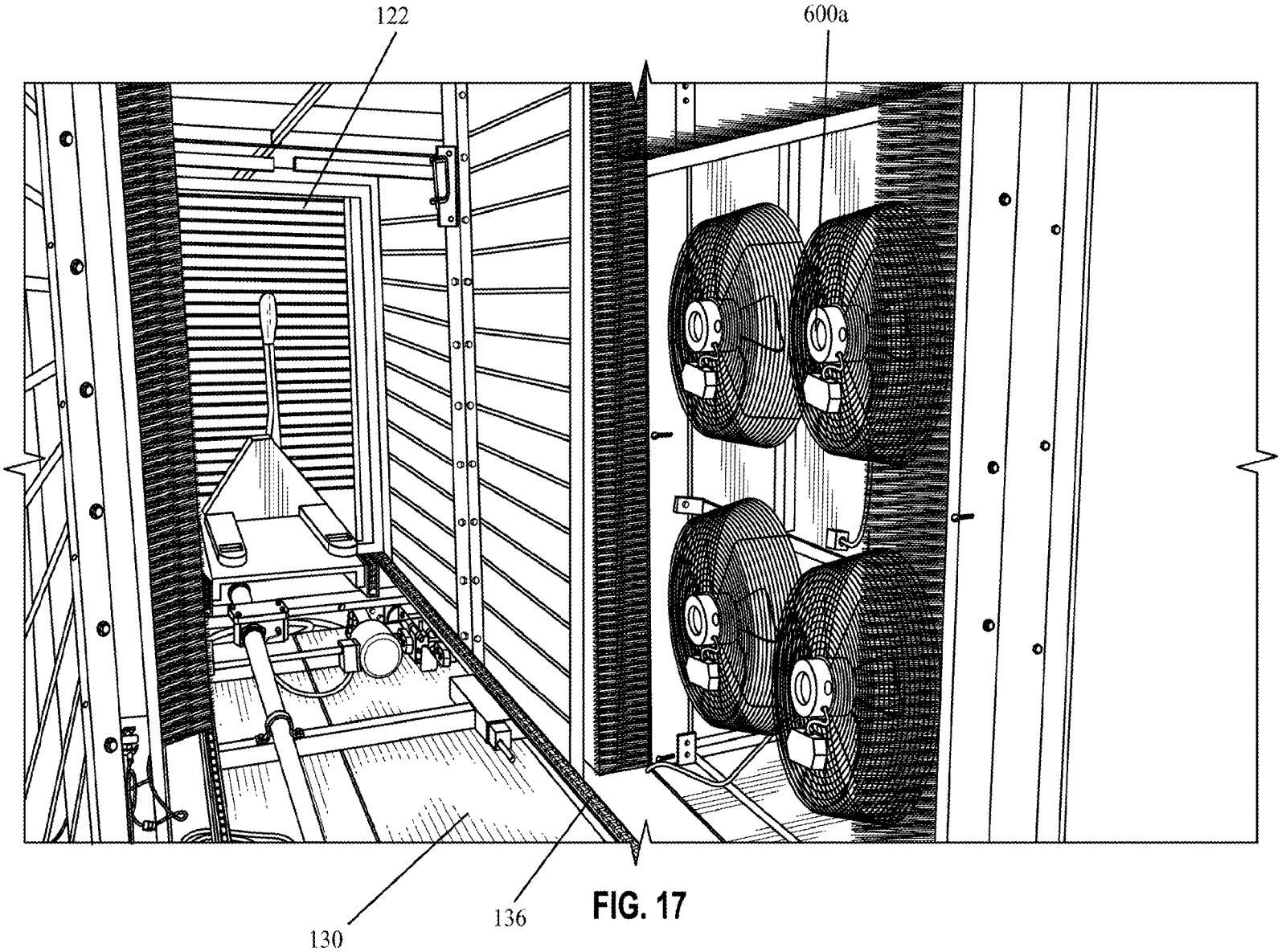
FIG. 17 is an internal view featuring aspects of a conveyor system of the present disclosure.

As indicated in FIGS. 16-17, in embodiments, conveyors in conveyor system 130 may be inserted into the floor of container 350 via conveyor guides 134 and welded to the floor of container 350. Conveyors 130 may be located within a single section 200, 300, 400 or may cross over into different sections 200, 300, 400.

Conveyor system 130 may be driven via connections to electric motors 132 mounted in container 350. As indicated in FIGS. 16-17, motors 132 may be mounted on either side of conveyor system 130. In an exemplary embodiment, five motors 132 may independently control each conveyor in conveyor system 130. In other embodiments, conveyor system 130 may be hydraulically driven or driven via other suitable systems. The speed of the conveyors in the conveyor system 130 may be adjustable as needed. For e.g., conveyors in conveyor system 130 may move up to 30 feet per minute. In an embodiment, speed of the conveyor system 130 may be controlled via connections to a variable frequency drive (VFD) controlled by a PLC mounted within container 350. In an exemplary embodiment, speed of the conveyor system 130 may be controlled through an Allen-Bradley PowerFlex® 525 AC Drive via EtherNet/IP with an Allen-Bradley CompactLogix™ 5370 controller.

Referring back to FIGS. 4 and 5, first section 200 of cooling container 350 is configured to act as a staging chamber and hold at least one pallet 150 containing fresh harvested produce in a semi-cooled environment. In this embodiment, first section 200 is not ventilated with any ductwork. At least one pallet 150 may be held in the first section 200 prior to conveyance into the second section 300 via the conveyor system 130. In an exemplary embodiment, first section 200 holds two pallets 150. See, e.g., FIG. 4. Alternatively, first section 200 may hold more or less pallets 150. In an embodiment, first section 200 may be ten feet long. However, first section 200 may have a larger or smaller size.

Second section 300 of cooling container 350 is configured to receive at least one pallet 150 containing fresh produce from the first section 200 and cool the produce. Particularly, second section 300 may be utilized as a cooling area including cooling mechanisms to cool the produce within the at least one pallet 150 to an optimal cooled temperature. In an exemplary embodiment, berries, such as blueberries, in at least one pallet 150 may be cooled to an optimal temperature of approximately 50 to 55 degrees Fahrenheit. However, other types of produce may be cooled in the cooling system 100 to its corresponding optimal cooled temperature. In an embodiment, second section 300 may be twenty feet long. However, second section 300 may be larger or smaller.

Although the optimal produce temperature is between about 50 to about 55 degrees, it may be desirable in some cases to cool the produce to below 50 degrees F., or even to just above freezing, such as to about 34 degree F. The mobile cooling container 350 can be configured to efficiently reduce produce to such temperatures in a short amount of time. When produce, such as fruit, is processed on a production line, it is sometimes desirable to provide the fruit in a near-frozen state, the theory being that near-frozen produce is harder and therefore more resistant to bruising, which can result from drops or other rough handling while on the production line. However, once fruit has been brought to a near frozen state, care must be taken to avoid allowing the fruit to warm up, which results in condensation and rapid spoilage. Additionally, for most purposes described herein, care must be taken to ensure that the produce remains at a temperature above freezing at all times; this is because once produce is frozen, it is considered "processed" and cannot be marketed or sold as "fresh." In order to facilitate these particular purposes, the mobile container 350 can be configured or set (e.g. by a thermostat or other controller) to drop the temperature of the fruit to just above freezing, such as 34 degrees F., by the third station 300*c*. The almost-frozen fruit is then removed from the container 350 and introduced into a production line. Robots can be used at the end of the trailer to load the fruit onto the production line. The production line area is a discrete area from the loading area and the pack off area. A production line takes in fruit that is very close to freezing and runs it through to the pack line. Although the produce arrives in a near-frozen temperature, the ambient air in the working part of the production line can optionally be warmer, such as about 50 degrees F., because it only takes about 1-2 minutes to traverse a production line with modern sorting equipment. The short exposure to the higher temp would likely not result in condensation, the enemy for enhancing spoilage. However, to avoid the risk of warming and condensation, the intake and discharge sections of the production line can be held near 34 degrees F. Typically, the boxed and packaged fruit is kept in the low 30*s* after being packed.

As shown in FIGS. 4 and 5, second section 300 includes a first cooling station 300*a*, second cooling station 300*b*, and third cooling station 300*c*, each of which may hold at least one pallet 150. However, second section 300 may utilize more or less cooling stations to cool produce within pallets 150 being transported across system 100. Further, each cooling station within second section 300 may hold more or less pallets 150.

Figure 6:
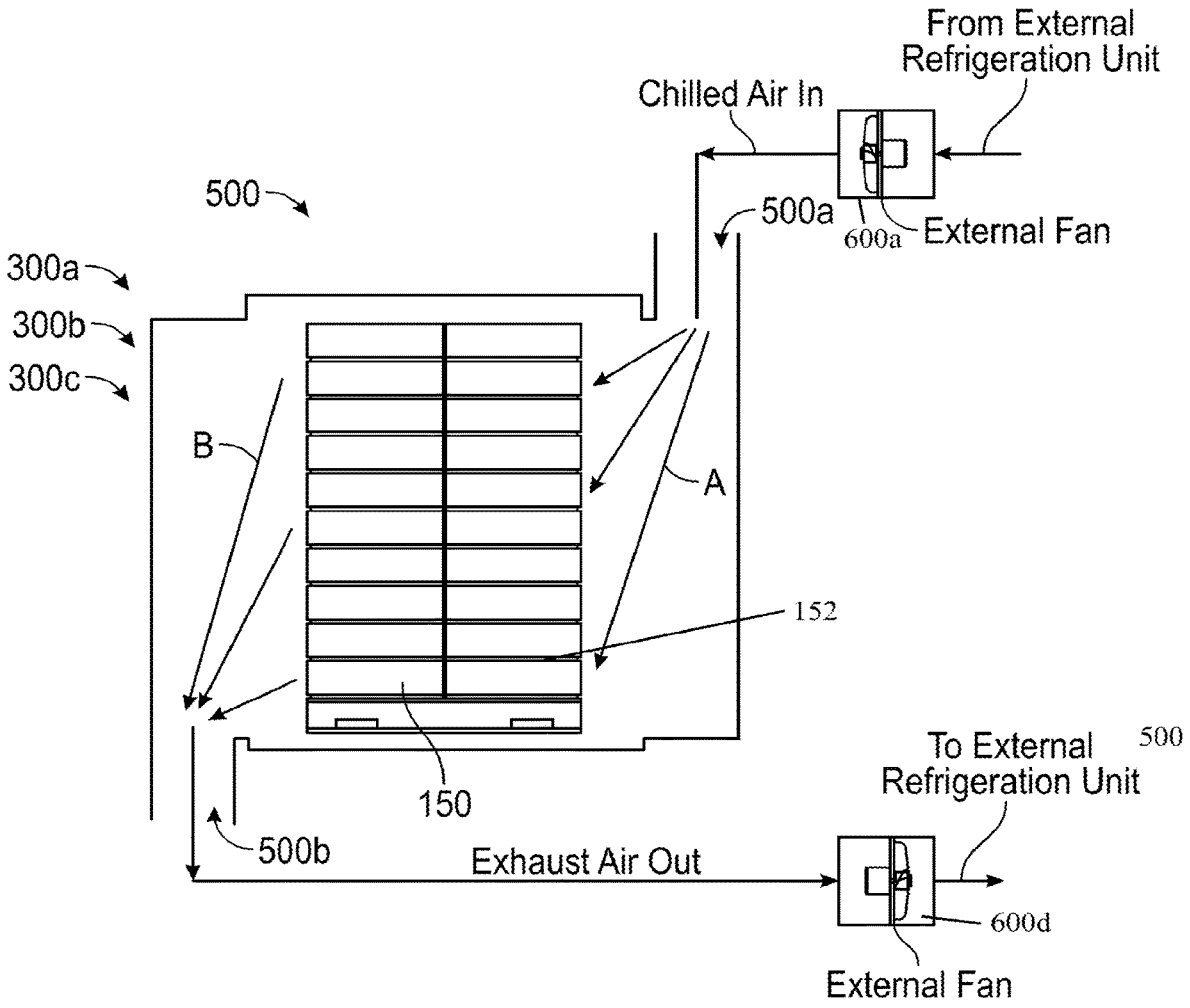
FIG. 6 is an illustration of an internal-external cooling mechanism of a cooling system, according to an exemplary embodiment of the present disclosure.

Second section 300 may include an internal-external cooling mechanism 500 to cool produce in at least one pallet 150. See FIGS. 3A and 5. FIG. 6 illustrates an example embodiment of the workings of internal-external cooling mechanism 500 in first cooling station 300*a*, second cooling station 300*b* and/or third cooling station 300*c*.

Internal-external cooling mechanism 500 as disclosed in embodiments of the present disclosure may include any forced air central systems, including but not limited to systems attached to ducts/ductwork, air handlers, air terminals/vents including supply air outlets and return or exhaust air inlets, etc. In an embodiment, cooling mechanism 500 may cool produce via connections to forced air refrigeration, whereby cooled/chilled air may be drawn through the produce and recycled via a heat exchanger. In this embodiment, container 350 may be attached via internal and external ductwork to external forced air refrigeration equipment (see FIG. 6), which equipment may be a mechanical, expansion/compression type refrigeration system where a compressed refrigerant gas may be passed into expansion coils. Water may be drawn from a retention sump and cascaded over the coils within a heat exchanger, and expanding refrigerant gas may draw heat from the water. Air may then be drawn upward through the chilled water cascade to remove heat from the air, and the resulting cooled/chilled air may then be pushed/forced into the container 350 through inlet ducts 500*a* via fans mounted outside the container 350. See FIGS. 3A, 3B, and 6. Chilled air may be blown at the produce in pallet 150 (shown as direction A in FIG. 6) to remove ambient heat from the produce, and the resulting warmed air may then be pulled back out and through return outlet ducts 500*b* (shown as direction B in FIG. 6), and eventually cycled back through the externally located water cascade. The process may then be repeated until a desired/optimal reduction in temperature of the produce is reached.

Internal-external cooling mechanism 500 may include a lightweight detachable air inlet and outlet system attached to a track system mounted on a top exterior of container 350. See FIGS. 3A, 3B, 5, and 6. For e.g., two air inlets 500*a* may be positioned between two air outlets 500*b*, with the air inlets 500*a* and outlets 500*b* mounted on a top exterior of container 350 adjacent to first section 200. See FIGS. 3A, 3B, and 6. As shown in FIGS. 3A, 3B, in embodiments, the four air inlets 500*a* and/or outlets 500*b* may constitute flexible ducts 500*a*, 500*b* that attach (via for e.g. hoses) to an external AC unit/refrigeration trailer such as for e.g., a Trane® AC unit. See FIG. 6. In exemplary embodiments, the four air inlets 500*a* and/or outlets 500*b* may protrude up to a foot and a half out from the frame of the container 350. See FIGS. 3A, 3B, and 5.

In exemplary embodiments, RA inline fans 600*a*, 600*d* may be placed outside container 350 between an external AC/refrigeration unit 500 and container 350. See FIG. 6. Inline fans 600*a*, 600*d* may have a variable speed and rotation of inline fans may be controlled via Variable Frequency Devices (VFDs) connected to a PLC mounted within container 350. In an exemplary embodiment, fans may be inline fans offered by Greenheck Fan Corporation.

Placement of inline fans and external AC unit may be dependent on wind direction. For e.g., inline fans and attached AC unit and generator may be placed downwind of container 350 to avoid exhaust fumes from a diesel generator. Inline fans are utilized in order to increase the Cubic Feet per Minute (CFM) in container 350 by ensuring that air moves quickly though the flexible duct inlets 500*a* and outlets 500*b* mounted adjacent to the first section 200 and external to the container 350. See FIGS. 3A, 3B, and 5. It is important to move air quickly though the flexible ducts and into insulated ducts in the container 350 since heat can be lost as the air is pushed through these flexible ducts.

As shown in FIG. 5, each of first cooling station 300*a*, second cooling station 300*b*, and third cooling station 300*c* may include at least one duct opening 311 for attachment of ductwork to perform cooling mechanism 500 in second section 300. In an exemplary embodiment, at least one duct opening 311 may be an approximately 50-inch×64-inch sized rectangular opening. However, at least one duct opening 311 may have other suitable sizes or configurations to assist in cooling of produce and for attachment of different sized cooling systems. In an exemplary embodiment, insulated ducts may be inserted into the container 350 and welded to duct openings 311 in a stainless steel metal frame of each station 300*a*, 300*b*, 300*c* of second section 300.

Features can be provided to improve accessibility to the system 100, 1000, such as for maintenance of the various components. Sidewalls of the mobile container 350 can be provided with access openings at strategically selected locations along the length of the mobile container 350. For example, an access opening can be provided adjacent to any or all of the cooling stations 300*a*, 300*b*, 300*c*. The access openings allow access to components of the cooling system for monitoring of operations and maintenance of components. The access openings can be provided with doors for selectively sealing and unsealing the openings to provide access to the interior of the mobile container 350. The doors can be various forms, such as roll-up, sliding, hinged, and the like, depending on the needs and operating conditions. Since openings typically reduce insulation, the openings and doors may be provided with air tight seals, such as through the use of gaskets and compression latches.

In particular embodiments, internal-external cooling mechanism 500 may include chilled air blown at high velocity over produce in at least one pallet 150 to take ambient heat out of the produce. See, e.g, FIGS. 4 and 6. As the berries may be "piled" as high as six inches in the pallets 150, the blast of air being blown at the produce must be strong enough to reach the center of each pallet 150. To accomplish this strong air flow, chilled air may be blown at produce in varying speeds and from opposing sides of the produce as it is transported across the second section 300. In some embodiments, chilled air may have a temperature of +/−5 degrees of a preset targeted exit temperature for when the produce exits the second section 300. In other embodiments, the produce may simply be exposed to colder air with a temperature much lower than a targeted exit temperature so as to speed up the cooling process in system 100.

As shown in FIGS. 4 and 5, at least one pallet 150 may be located at first cooling station 300*a*. Internal-external cooling mechanism 500 in first cooling station 300*a* may include cooled air outputted via vents located on a first side of the first cooling station 300*a* to cool produce in at least one pallet 150, with ambient heat from the produce being exhausted out via vents located on an opposing second side of the first cooling station 300*a*.

At least one pallet 150 may then be moved down to second cooling station 300*b* via conveyor system 130. Cooling mechanism 500 in second cooling station 300*b* may include cooled air outputted via vents located on a first side of the second cooling station 300*b* to cool produce in at least one pallet 150, with ambient heat from the produce being exhausted out via vents located on an opposing second side of the second cooling station 300*b*.

At least one pallet 150 may then be moved down to third cooling station 300*c* via conveyor system 130. Cooling mechanism 500 in third cooling station 300*c* may include cooled air outputted via vents/ducts located on a first side of the third cooling station 300*c* to cool at least one pallet 150, with ambient heat from the produce being exhausted out via vents located on an opposing second side of the third cooling station 300*c*.

In exemplary embodiments, input and output vents may be positioned on opposing sides of adjacent stations 300*a*, 300*b*, 300*c* in an alternating, staggered configuration. As shown in FIG. 4, vents on the first and second side of the second cooling station 300*b* are positioned on the same side as vents on the second and first side of the first cooling station 300*a* and third cooling station 300*c*, respectively. Alternatively, other configurations for cooling may be used in cooling system 100.

Vents/ducts in the first side of the first, second, and third cooling stations 300*a*, 300*b*, 300*c* may each include at least one mechanized damper controlled by a PLC via an analog connection. At least one mechanized damper may close and open to control how much air is entering/flowing into the first, second, and third cooling stations 300*a*, 300*b*, 300*c* and onto produce in at least one pallet 150. Vents/ducts in second side of first, second, and third cooling stations 300*a*, 300*b*, 300*c* may each include at least one air velocity sensor configured to communicate with the PLC 260 connected to VFDs of inline fans 600*a*, 600*d* described herein to instruct the fans 600*a*, 600*d* to speed up to facilitate pulling of air up and out the system 100.

Once cooling mechanism 500 of second section 300 cools produce in at least one pallet 150 to a desired optimal temperature, at least one pallet 150 containing chilled produce may be moved to third section 400 of container 350 via conveyor system 130. Third section 400 may include a cooling mechanism 500 substantially similar to cooling mechanism in second section 300. Particularly, third section 400 may act as an outlet chamber and maintain chilled produce in the at least one pallet 150 at the desired/exit temperature via cooled air outputted via vents located on opposing sides of the third section 400 onto the at least one pallet 150. Further, third section 400 may also include at least one duct opening 311 for attachment of ductwork to perform cooling mechanism in third section 400. See, e.g., FIG. 5. In an exemplary embodiment, insulated ducts may be inserted into the container 350 and welded to duct openings 311 in third section 400.

Third section 400 may maintain the chilled produce in the at least one pallet 150 at the optimal temperature until it is ready for unloading and transportation to another area for further refrigeration and processing. In some embodiments, at least one pallet 150 containing chilled produce may be removed from the third section 400 via an un-motorized conveyor ramp to a cold storage location where it may be held at the exit temperature. Cold storage location may be a cold/refrigerated reefer trailer and/or other movable or nonmovable structures having the capability to store and maintain the produce at a desired temperature.

In alternative embodiments, at least one pallet 150 containing chilled produce may be removed from container 350/system 100 via other mechanisms, e.g., automated conveyors, lifts, etc. In some embodiments, a user may physically open a door adjacent to third section 400 to accept at least one pallet 150 containing chilled produce. In other embodiments, a user may automatically open the door via systems such as screw drive, belt drive, and/or chain drive garage door opener systems. Once the door is open, at least one pallet 150 may be removed off conveyor system 130 in the third section 400 by a user via for e.g., a hand pallet jack.

Cooling system 100 may further include a sensor feedback system 250 including at least one sensor placed within the at least one pallet 150 containing produce and/or attached to an interior of container 250. See, e.g., FIG. 4. At least one sensor may be but is not limited to an air velocity sensor described herein, temperature sensor, humidity sensor, position sensor such as a photoelectric sensor (photo eye), proximity sensor, and/or pressure sensor. At least one sensor may further be any device (such as a load sensor/cell further described herein) used to measure and track weight of pallet 150 containing produce.

Sensor feedback system 250 may be automated or operated by a user.

Sensor feedback system 250 may be a dynamic, real-time system configured to continuously measure, track, and obtain feedback/information regarding the produce within the at least one pallet 150 being transported through the container 350/cooling system 100. As described herein, sensor feedback system 250 may output this information directly to a PLC and/or computer via hardwired and/or wireless connections, which information may then be stored and/or outputted to a web address/user interface accessible by a user computing device such as, e.g., a mobile device, and/or directly to a user computing device. See FIGS. 1 and 2.

In particular embodiments, sensor feedback system 250 may include temperature monitoring devices/sensors placed within at least one pallet 150 containing produce. Temperature sensors may be placed at various locations within the at least one pallet 150. For e.g., temperature sensors may be placed within bins of produce located in the middle and/or outer edges of at least one pallet 150. In embodiments, each pallet 150 may include at least four temperature sensors, with each pallet 150 being approximately sixty inches tall. In an exemplary embodiment, temperature sensors may be an RFID temperature sensor 705 manufactured by Phase IV Engineering, Inc. Temperature sensors 705 may be used to obtain information regarding produce, including but not limited to the exact temperature of produce in the at least one pallet 150, the specific location of the produce with that temperature within the at least one pallet 150, as well as the location of the at least one pallet 150 itself.

In various embodiments, sensor feedback system 250 may include eleven position sensors to track location of at least one pallet 150 on a conveyor system 130. For e.g., photoelectric sensors (photo eyes) may be used to determine the distance, absence, and/or presence of at least one pallet 150 by using a light transmitter (generally infrared) and a photoelectric receiver. Photo eyes may be removably mounted on one side of container 350 and wired into an electrical box attached to conveyor system 130. In an exemplary embodiment, one photo eye may be mounted at the beginning and end of each of five conveyors in a conveyor system 130, as well as at the entrance of the container 350 to track whether at least one pallet 150 has entered the container 350. In this embodiment, at least one pallet 150 passing the first photo eye may indicate that it is fully on a conveyor, and at least one pallet 150 passing any subsequent photo eyes may indicate its corresponding position on the conveyor system 130.

In some embodiments, sensor feedback system 250 may further include capacitive proximity switches/sensors mounted in container 350 to act as secondary sources for reading whether there is any weight on the conveyors in conveyor system 130, thereby allowing a user to determine the location of at least one pallet 150 on conveyor system 130. Furthermore, utilizing the photo eyes and/or capacitive proximity sensors may allow a user to determine when at least one pallet 150 is transferred between conveyors 136 in conveyor system 130, and therefore, when to turn these conveyors on and off.

Sensor feedback system 250 may also include humidity sensors attached to an interior of the container 350 to track the humidity within the container 350. In a particular embodiment, one humidity sensor may be placed in each of the first cooling station 300*a*, second cooling station 300*b*, third cooling station 300*c*, and third section 400. Particularly, one humidity sensor may be placed in the internal walls of ducts in each of the first cooling station 300*a*, second cooling station 300*b*, third cooling station 300*c*, and third section 400. In this embodiment, each humidity sensor may be located on one side of container 350 and wired into an electrical box attached to conveyor system 130. In alternative embodiments, any number of humidity sensors may be located in any location within each section 200, 300, 400 of the container 350.

In exemplary embodiments, sensor feedback system 250 may include an RFID feedback system whereby load/weight, temperature and/or humidity sensors may send relevant weight, temperature and/or humidity information via wired and/or wireless connections to an RFID reader 701 attached to an interior of container 350. RFID reader may be configured to pull relevant sensor information via a wireless Near Field Communication (NFC) connection. In embodiments, RFID reader may be connected (wirelessly or by wired connections) to a PLC such that the RFID reader may transmit relevant temperature and/or humidity information to the PLC. PLC may then transmit the temperature and/or humidity information via a Wi-Fi connection to a web address/user interface accessible by a user computing device 282 such as for e.g., a mobile device. See, e.g., FIG. 1. In an exemplary embodiment, RFID reader 701 may be the SIMATIC RF670R device from Siemens AG.

In a particular embodiment, an RFID reader antenna 703 may wirelessly read RFID tags 705 inserted/placed within the at least one pallet 150 to determine the current temperature of the produce within the at least one pallet 150. This temperature reading may be received and stored by the RFID reader 701, which RFID reader 701 may then transmit the reading to a PLC 260 connected to the RFID reader 701. In other embodiments, Wi-Fi temperature and/or humidity sensors may wirelessly transmit the reading directly to a PLC. In either embodiment, the PLC may output the rea701701ding to a web address/user interface accessible by a user computing device. See, e.g, FIG. 1. A recurring RFID/electronic feedback loop may then track the location of the at least one pallet 150 and/or monitor the amount of cooling in the container 350 to ensure temperature of the produce is consistent with an expected/preset temperature for produce upon exiting the second section 300 and/or third section 400, and to prevent freezing.

Sensor feedback system 250 may further be used to control the movement of the conveyor system 130 described herein based on the temperature measurement being tracked as at least one pallet 150 is moved down cooling container 350. Sensor feedback system 250 may control the conveyor system 130 via connections to the PLC 260 mounted in container 350. In embodiments, the speed of the conveyor system 130 may be varied based on the size of the pallet 150 and temperature of the produce within the pallet 150 upon entrance into the first section 200 of container 350.

In exemplary embodiments, different run options may be utilized to move at least one pallet 150 across container 350 via conveyor system 130 connected to the PLC 260 described herein. In one embodiment, at least one pallet 150 may be continuously inserted into and moved through the container 350 such that at least one pallet 150 traverses the entirety of the container 350 in a range of approximately fifteen to forty five minutes. In an embodiment of this "continuous" cooling embodiment, at least one pallet 150 may be moved through the second section 300 at a rate of 1 minute/foot in a slow but consistent manner. In other embodiments, system 100 may cool approximately three pallets 150 every forty-five minutes.

In another "stop and go" embodiment, at least one pallet 150 may be immediately moved to first cooling station 300*a* where cooled air may be outputted via vents/ducts onto produce in the at least one pallet 150. Temperature sensors in sensor feedback system 250 may then measure and track temperature of produce in at least one pallet 150 until temperature reaches an optimal temperature, at which point at least one pallet 150 may be immediately moved to second cooling station 300*b*, and then successively to third cooling station 300*c* and third section 400 for additional tracking and cooling.

In yet another "accrual" embodiment, a reefer may not be available for unloading at least one pallet 150 containing chilled produce, so multiple pallets 150 containing chilled produce may be loaded onto conveyors in conveyor system 130 and accrued within container 350. This embodiment allows a user to cool and store multiple pallets 150 of produce even if options to unload the pallets 150 are not yet available.

In embodiments, once the at least one pallet 150 is brought to the desired exit temperature and held in the third section 400 of the container 350, an operator/user outside of the cooling container 350 may assist in ejection/removal of the at least one pallet 150 as described herein. In other embodiments, sensor feedback system 250 may be automatically preset via RFID controls to output the at least one pallet 150 on a timed basis by opening the automatic roll up door 122 when it is at the optimal temperature.

Sensor feedback system 250 may be powered via connections to a power source located in the container 350. Power source may include other forms of power, e.g., a battery, direct wired connection into the container 350 itself, etc.

Figure 14:
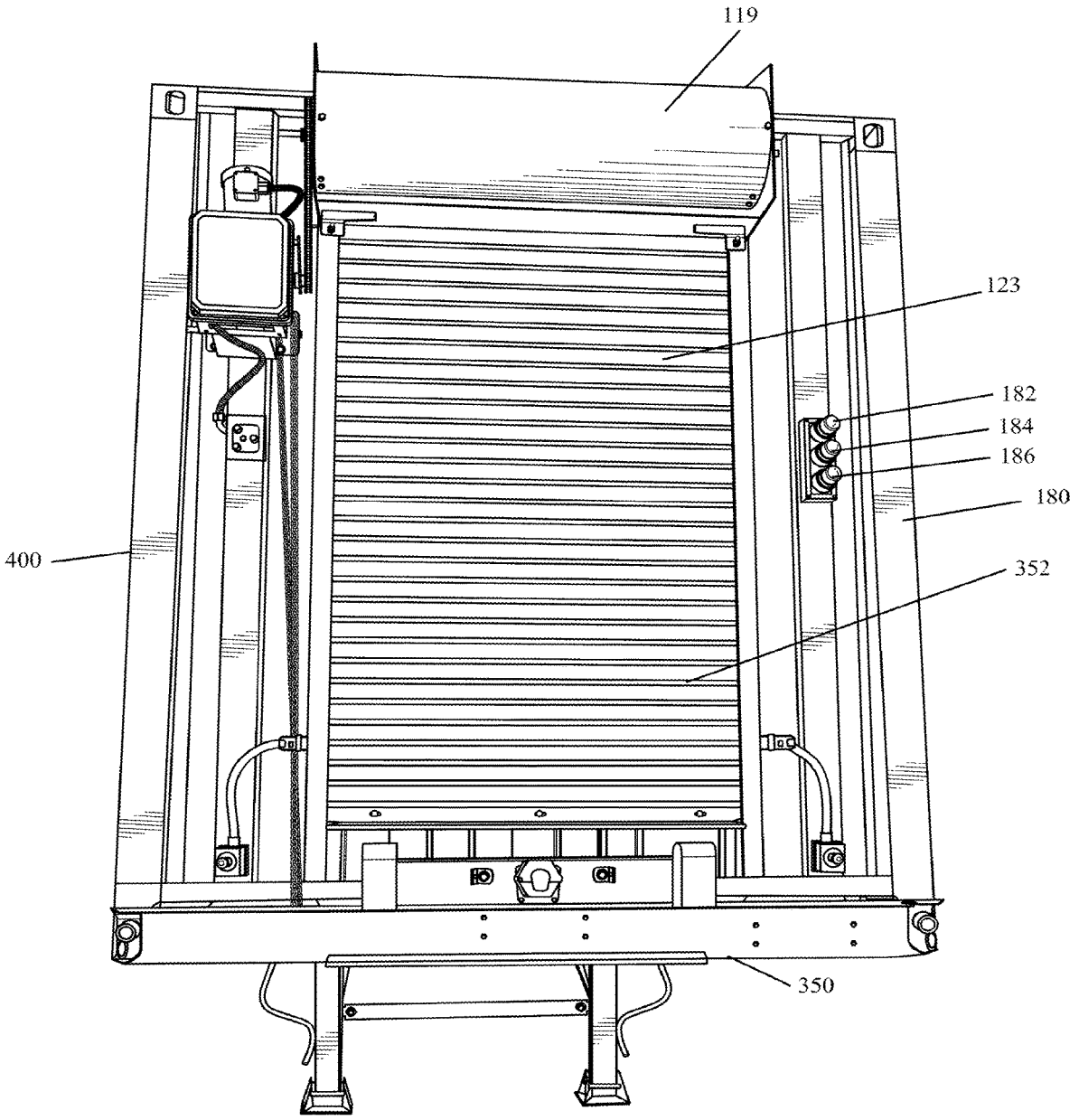
FIG. 14 is a view of an output end the cooling system of the present disclosure.
Figure 15:
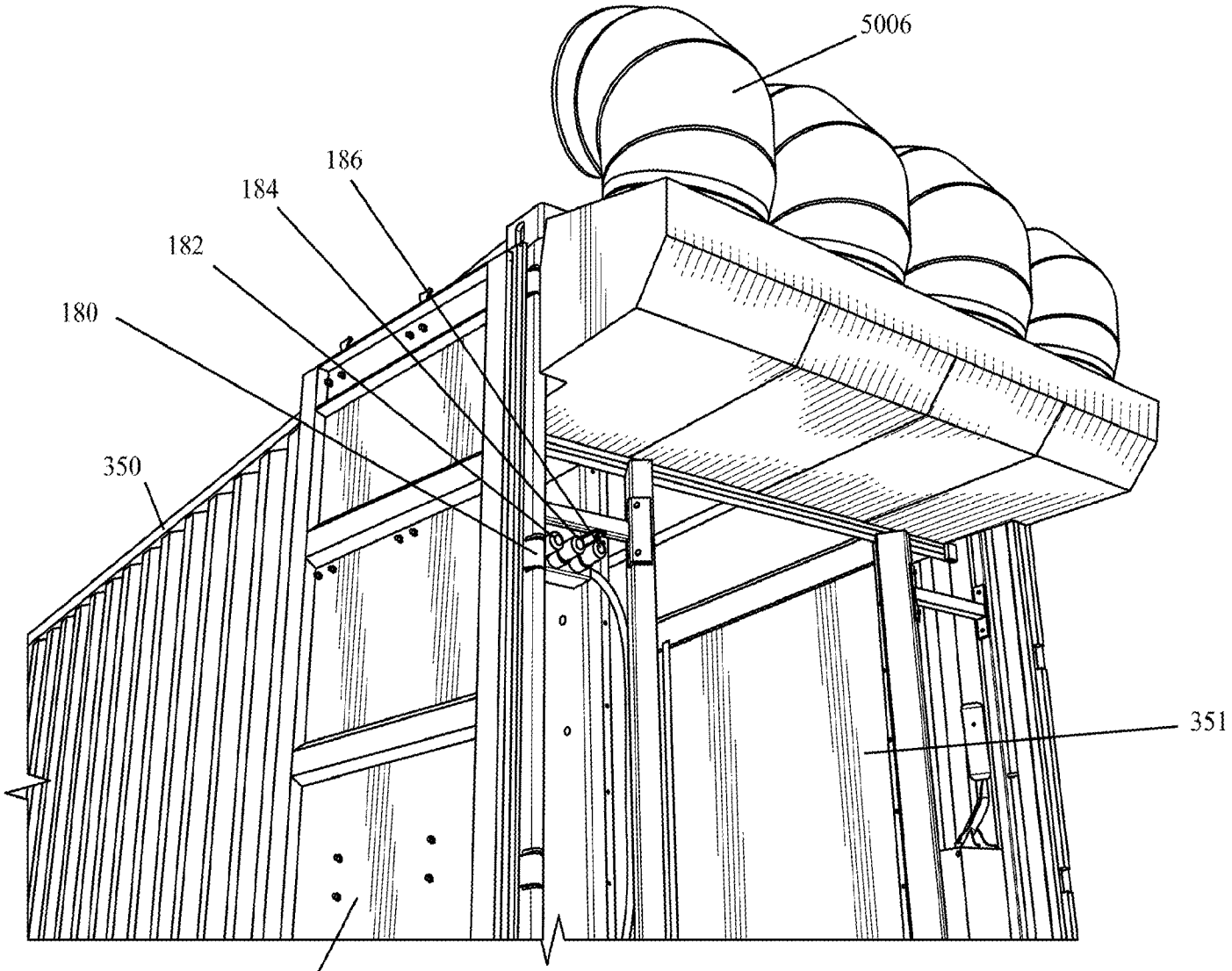
FIG. 15 is a view of an input end of the cooling system of the present disclosure.

As shown in FIGS. 14 and 15, cooling system 100 may further include a visual/lighting system 180 located on an exterior of the container 350. As shown in FIG. 14, the visual system 180 may be provided on the output opening end 352 of the mobile container 350. As shown in FIG. 15, the visual system 180 can be provided on the input opening end 351 of the mobile container 350. Visual system 180 may be mounted onto container via either permanent or non-permanent attachment mechanisms, for e.g., an adhesive. Visual system may be controlled by a PLC mounted in container 350. In embodiments, visual system may include red and green lights 182, 184, 186 configured to provide notification to an operator to load a new pallet 150 into the container 350. In this embodiment, visual system may show the red light 182 to indicate to the operator to hold off on loading/unloading the pallet 150 and a green light 186 to indicate to the operator to proceed to load/unload the pallet 150. In other embodiments, red, yellow, and green lights 182, 184, 186 may be mounted to the outside of each of the first and third sections 200, 400. For e.g., the three lights 182, 184, 186 may each be mounted on opposing sides of a rolling door described herein attached to the outside of the third section 400. In this embodiment, visual system may show the red light to indicate to the operator that a pallet 150 is inside the container 350 but not ready for unloading, a yellow light to indicate that the pallet 150 is moving into the third section 400 for unloading, and a green light to indicate to the operator that the pallet 150 is ready for unloading. In some embodiments, red, yellow, and green lights may be a row of red, yellow, and green LEDs (light-emitting diodes). Alternatively, cooling system may include other suitable visual, audio, and/or audiovisual systems to notify a user to load pallets 150 in the container 350.

Figure 8:
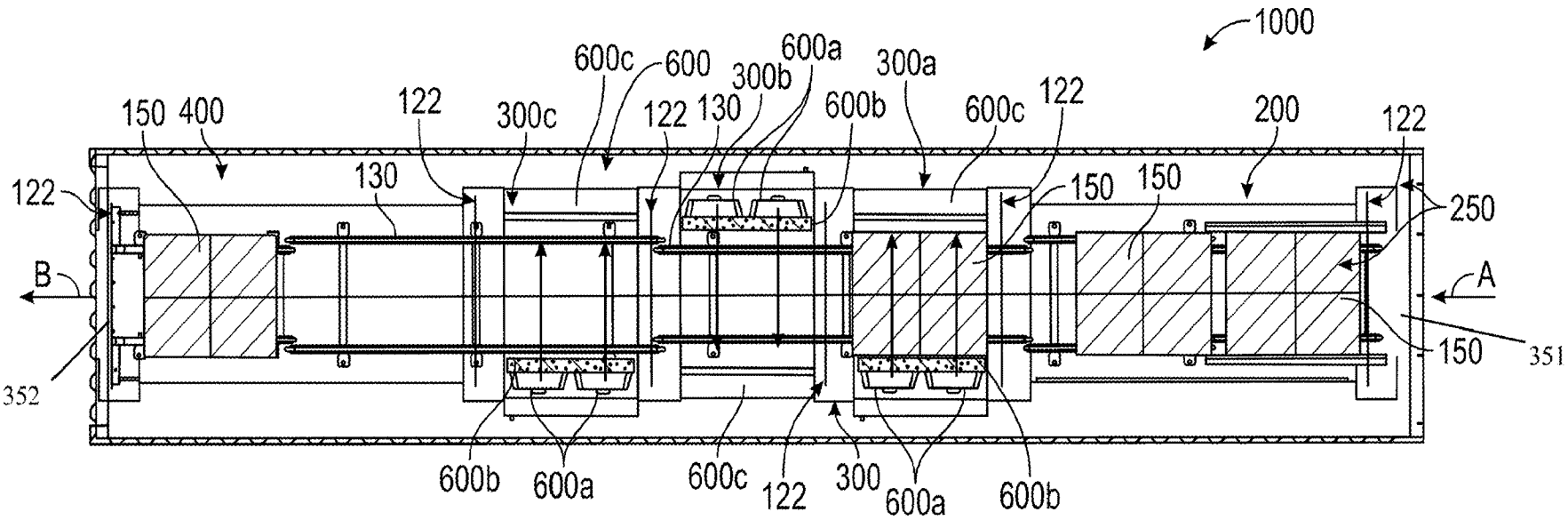
FIG. 8 is a top internal view of the cooling system shown in FIG. 7.
Figure 9:
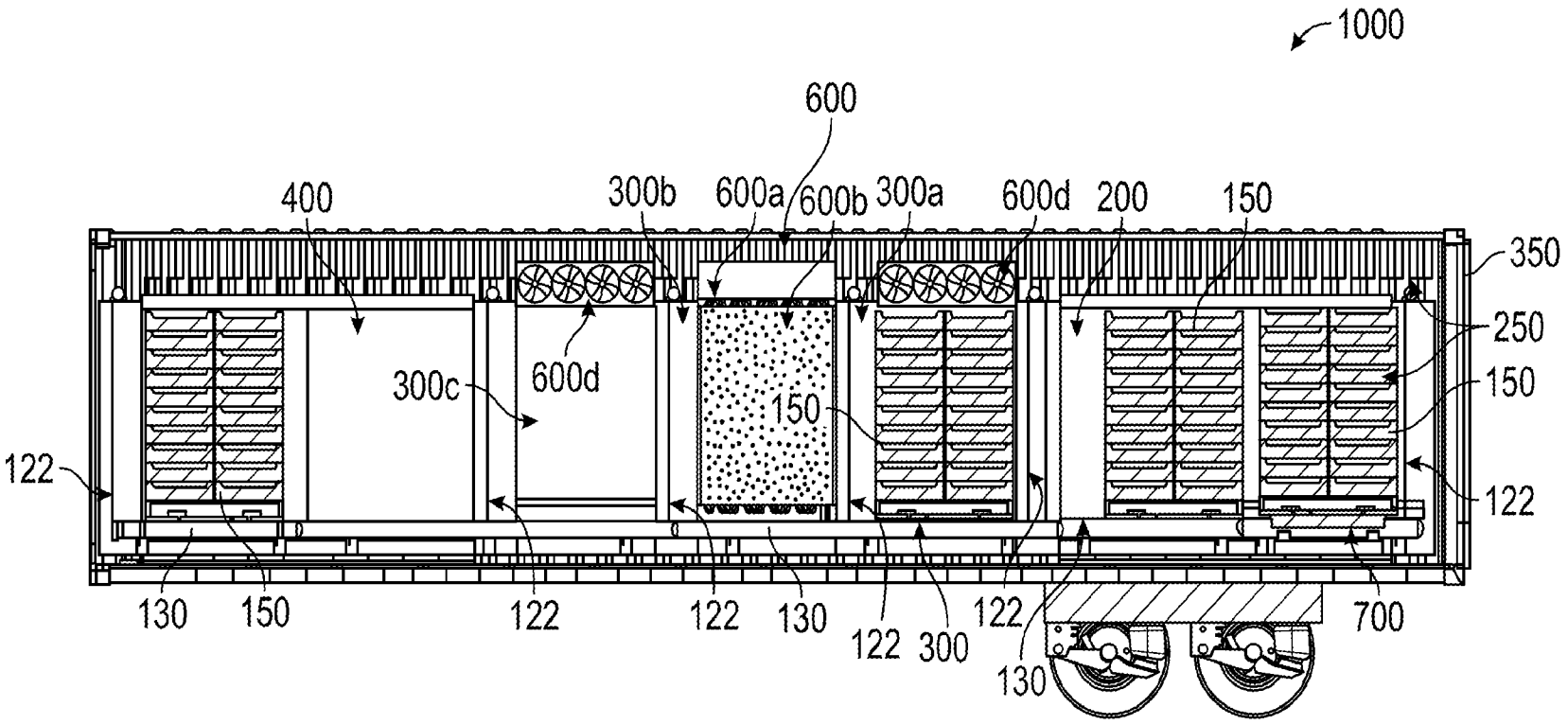
FIG. 9 is a side cross-sectional view of the cooling system shown in FIG. 7.
Figure 10:
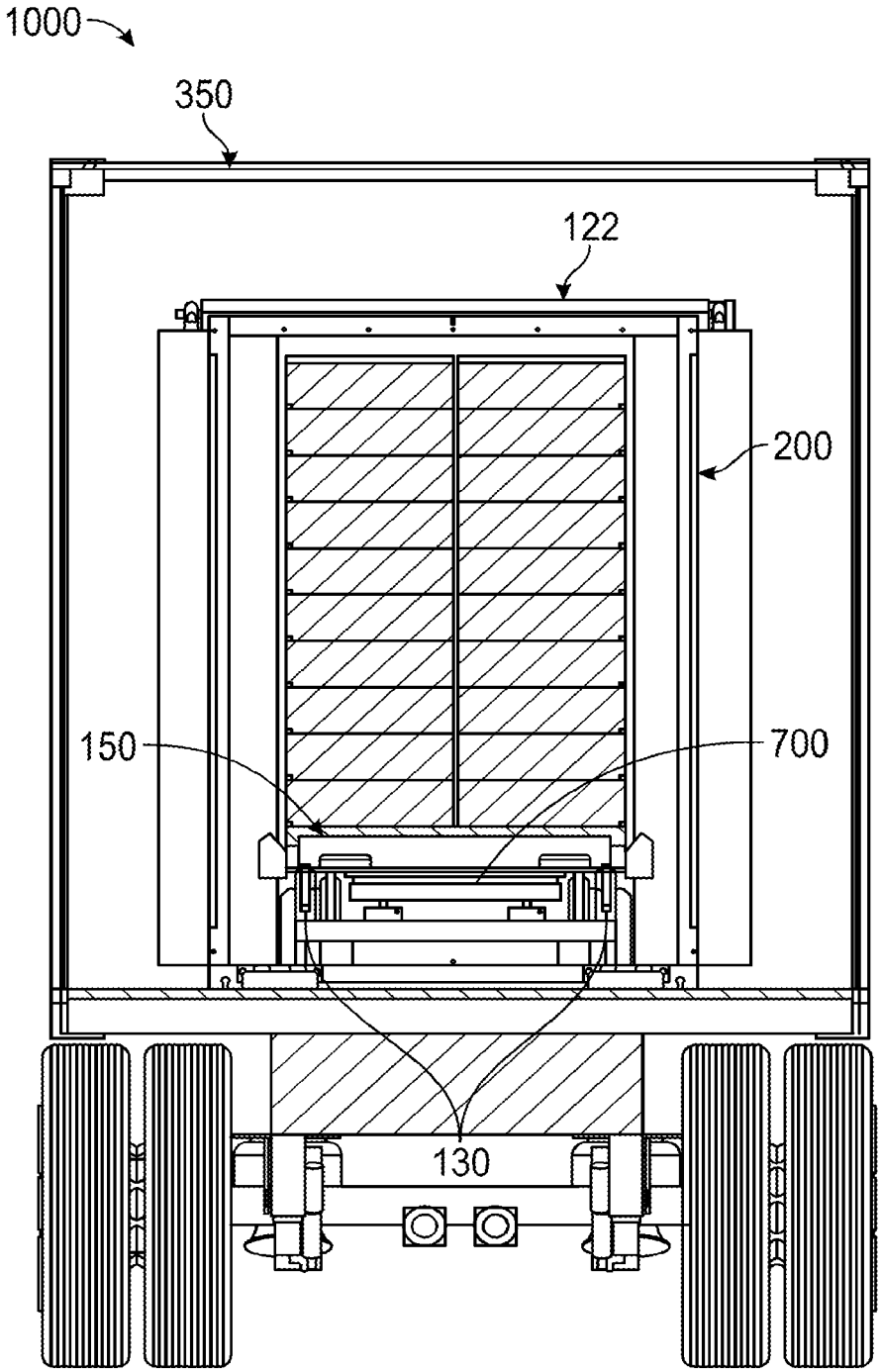
FIG. 10 is a rear cross-sectional view of an interior of the cooling system shown in FIG. 9.

FIGS. 7 to 10 show different views of cooling system 1000, an alternative embodiment of cooling system 100. FIG. 7 is a front isometric view of cooling system 1000. FIG. 8 is a top internal view of cooling system 1000. FIG. 9 is a side cross-sectional view of an interior of cooling system 1000. FIG. 10 is a rear cross-sectional view of an interior of cooling system 1000.

Cooling system 1000 may have substantially the same features as cooling system 100, including but not limited to container 350 (and first section 200, second section 300, first cooling station 300*a*, second cooling station 300*b*, third cooling station 300*c*, and third section 400), conveyor system 130, sensor feedback system 250, at least one pallet 150, PLC, and computer sending produce and/or container 350 data to a user and/or databases. See FIGS. 1 and 2.

As shown in FIGS. 9 and 10, cooling system 1000 includes a scale 700 integrated/installed with (for e.g., a chain drive of) conveyor system 130 and used to measure weight of the at least one pallet 150 upon entering the system 1000. Scale 700 may be any type of load cell/sensor that may be used to measure weight of at least one pallet 150. Load cell/sensor may be any physical element/transducer that may translate pressure (force) into an electrical signal. In embodiments, load cells/sensors of scale 700 may be connected to and send relevant weight information to PLC and/or computer in system 1000. See, e.g., FIG. 1. The computer may be configured to output this weight information to a web address/user interface accessible by a user from any user computing device (see, e.g., FIG. 1) and/or to continuously receive and store the weight information in a database in computer storage and/or in a database in the cloud (see, e.g., FIG. 2).

Further, as shown in FIGS. 6 to 8, this embodiment of cooling system 1000 includes fabric rollup doors 122 that separate first section 200, second section 300, and third section 400. Rollup door 122 may be fitted with sensors that act to automatically and quickly open and shut the rollup door 122 as at least one pallet 150 is conveyed across the system 1000 so as to prevent leakage of cold air from each section 200, 300, 400.

Unlike cooling system 100, which includes an internal-external cooling mechanism 500, cooling system 1000 includes a completely internal cooling mechanism 600 installed within container 350. This particular configuration of internal cooling mechanism 600 allows for elimination of all ductwork (including inlets 500*a* and outlets 500*b*) in internal-external cooling mechanism 500, thereby allowing for faster and more optimal cooling of the produce in at least one pallet 150.

Figure 11:
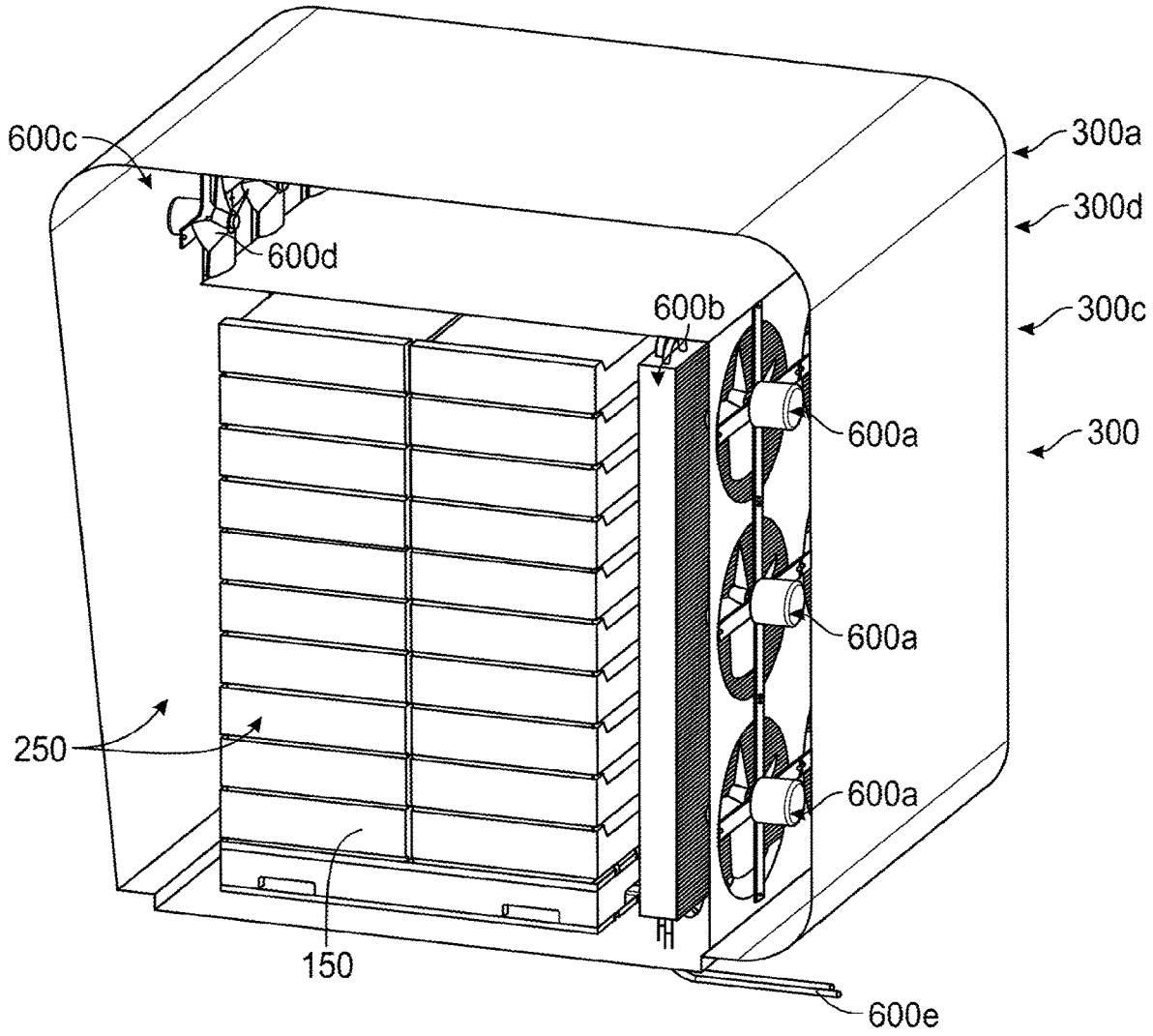
FIG. 11 is an isometric view of a cooling station of a cooling system, according to an exemplary embodiment of the present disclosure.
Figure 12:
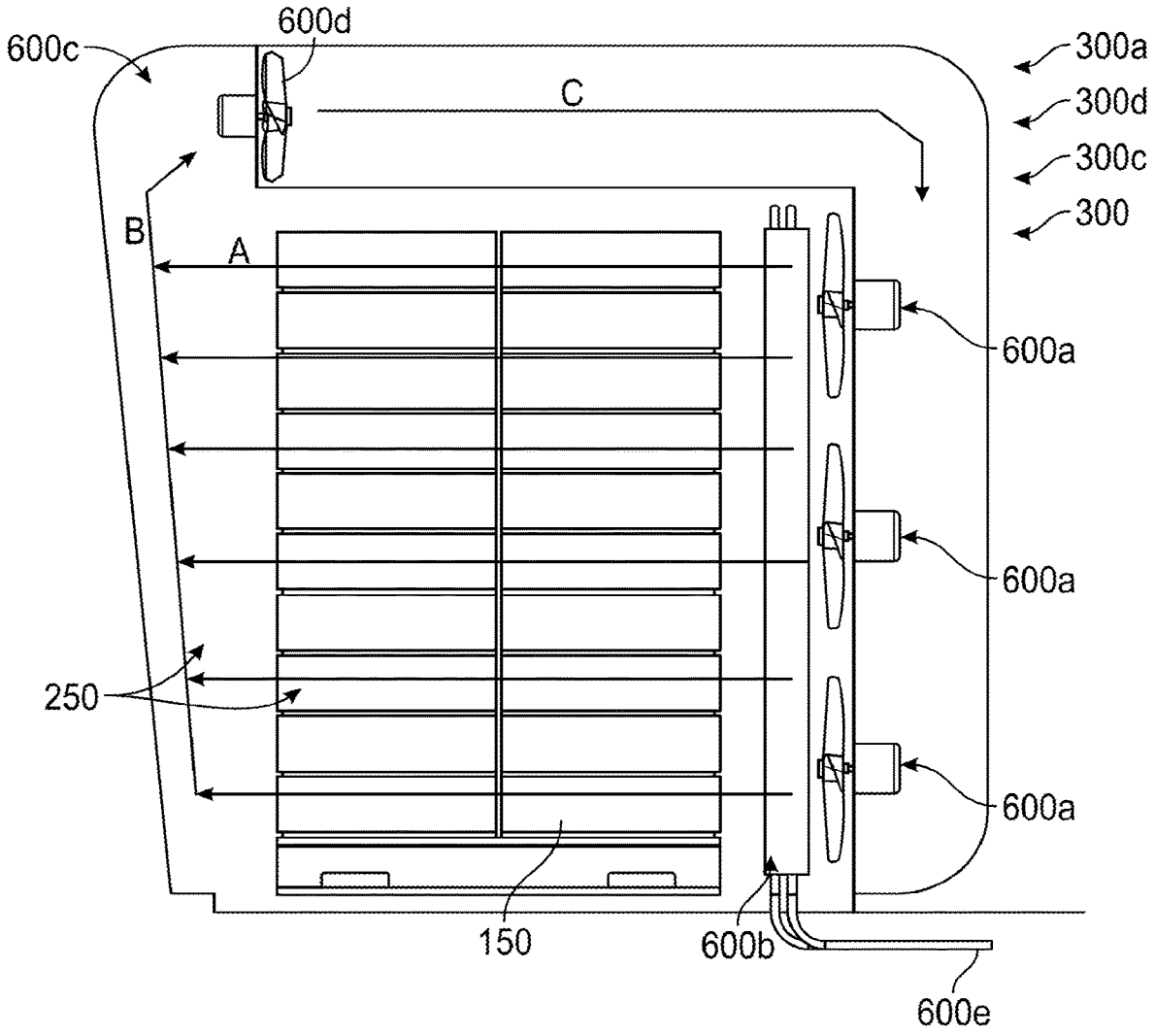
FIG. 12 is a front view of the cooling station shown in FIG. 11 illustrating an internal cooling mechanism of the cooling system.

FIG. 11 is an isometric view of an example embodiment of a cooling station 300*a*, 300*b*, 300*c* of second section 300 of cooling system 1000 that employs a "closed loop" based internal cooling mechanism 600. FIG. 12 is a front view of cooling station 300*a*, 300*b*, 300*c* shown in FIG. 11 illustrating the workings of internal cooling mechanism 600.

As shown in FIGS. 11 and 12, cooling mechanism 600 may be an internal air handler system that includes cooling fans 600*a* placed adjacent to cooling/condenser refrigeration coils 600*b* in an interior of each cooling station 300*a*, 300*b*, 300*c* such that chilled air is forcefully blown at at least one pallet 150 to thereby quickly cool produce in at least one pallet 150.

Refrigeration coils 600*b* and cooling fans 600*a* of cooling mechanism 600 may be utilized in substantially the same manner to cool produce in at least one pallet 150 as the external coils and fans in the internal-external cooling mechanism 500 as described herein, but with the entire cooling process being performed internally within each cooling station 300*a*, 300*b*, 300*c*. See, e.g, FIG. 12.

In an exemplary embodiment, a row of cooling fans 600*a* may be installed in a first side of an interior of each cooling station 300*a*, 300*b*, 300*c*. Cooling/condenser refrigeration coils 600*b* may be installed in interior of each respective cooling station 300*a*, 300*b*, 300*c* such that coils 600*b* are adjacent to both cooling fans 600*a* and at least one pallet 150. Opposing ends of chilled fluid lines 600*e* may be attached to coils 600*b* and to a portable commercial chiller 500. See FIG. 12. Commercial chiller 500 may be located external to container 350 or, in an exemplary embodiment, may be installed to a bottom exterior surface of container 350. As shown in FIG. 12, chilled fluid lines 600*e* include an input and return line.

In exemplary embodiments, fluid may be chilled in the commercial chiller and then introduced into each cooling station 300*a*, 300*b*, 300*c* via chilled fluid lines 600*e*. Fluid may be water or glycol based. A damper system can be used to control the air along with the fans. For certain products or climates, it may be necessary or helpful to introduce or exhaust moisture laden air from the container 350 or individual compartments 200, 300, 400 thereof. Fans 600*a* may then be activated to blow air at coils 600*b* to thereby allow for chilled air in the range of approximately 32 to 50 degrees to be blown at produce in at least one pallet 150 in direction A to remove ambient heat from the produce. See FIG. 12. Warmed air from the produce may then be pushed up within each cooling station 300*a*, 300*b*, 300*c* via return air duct 600*c* and return air fans 600*d* in direction B and recirculated/cycled back in direction C towards cooling fans 600*a* for re-cooling. This process may be repeated until a desired/optimal reduction in temperature of the produce is reached.

Cooling fans 600*a* and return air fans 600*d* may include any type of inline fans having a variable speed and a rotation that may be controlled via VFDs connected to a PLC mounted within container 350.

Each station 300*a*, 300*b*, 300*c* and at least one pallet 150 may include sensor feedback system 250 described herein. Sensor feedback system 250 and related sensors may be used to measure, track, and send relevant temperature information regarding the produce in at least one pallet 150 as well as regarding the air being circulated within each station 300*a*, 300*b*, 300*c*. Sensors may continuously provide this information to PLC and/or computer installed within container 350, which information may be used to provide feedback and control cooling of at least one pallet 150, including control of amount of chilled fluid entering each station 300*a*, 300*b*, 300*c*, and variability of speed of cooling fans 600*a* and return fans 600*d*.

In exemplary embodiments, cooling mechanism 600 may have a similar alternating, staggered configuration as internal-external cooling mechanism 500 described herein. Fans 600*a* and coils 600*b* in first cooling station 300*a* and third cooling station 300*c* may be positioned in an opposing side to fans 600*a* and coils 600*b* in second cooling station 300*b*. See FIG. 8. Similarly, return air ducts 600*c* and return air fans 600*d* in first cooling station 300*a* and third cooling station 300*c* may be positioned in an opposing side to return air ducts 600*c* and return air fans 600*d* in second cooling station 300*b*. See, e.g., FIGS. 8 and 12. Alternatively, other configurations for cooling may be used in cooling system 1000.

Figure 13:
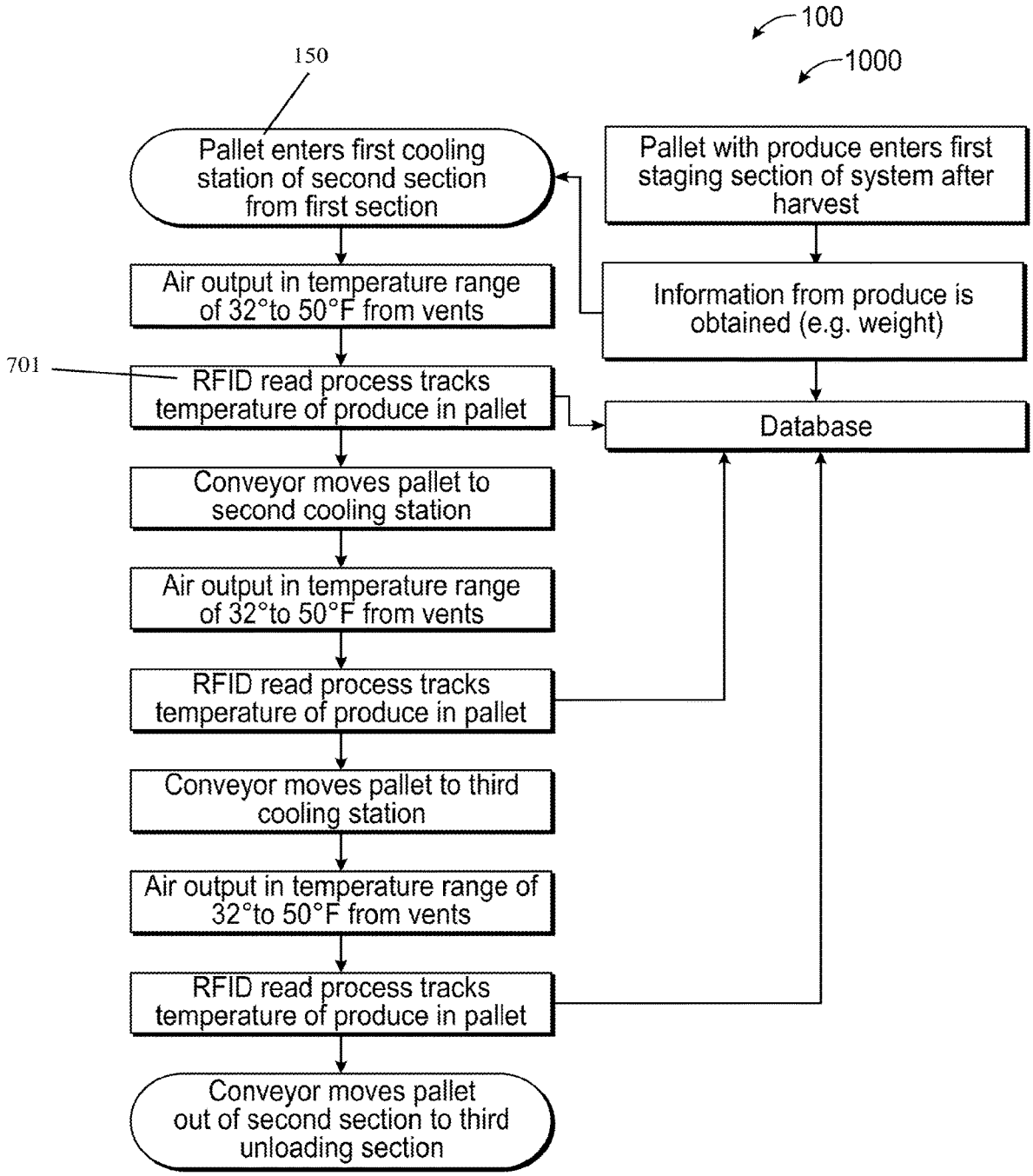
FIG. 13 is a flowchart of a cooling system, according to an exemplary embodiment of the present disclosure.
Figure 13A:
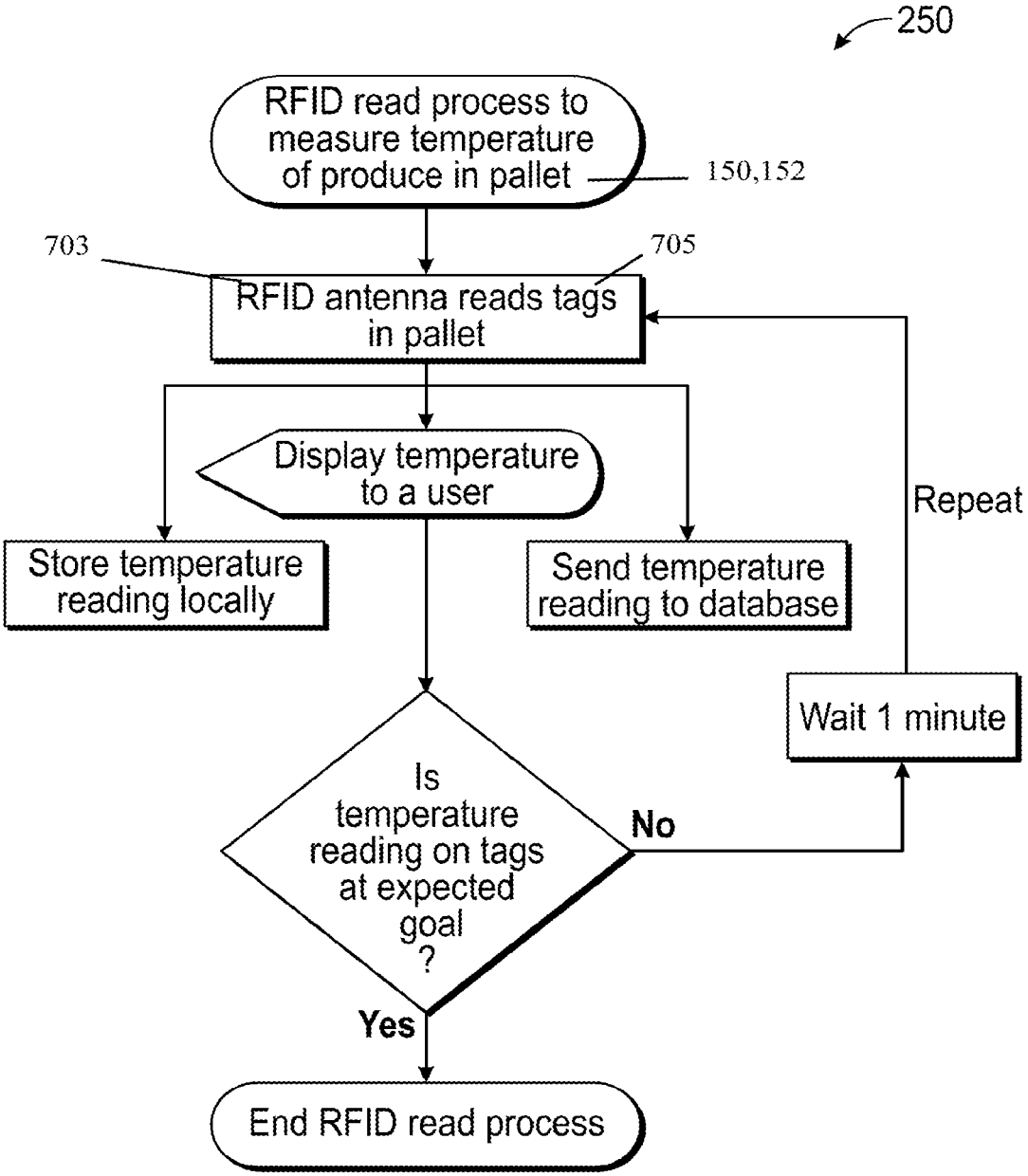
FIG. 13A is a flowchart of a sensor feedback system, according to an exemplary embodiment of the present disclosure.

FIG. 13 is a flowchart showing cooling systems 100, 1000 as described herein using sensor feedback system 250 as described herein. FIG. 13A is a flowchart showing a temperature reading process of sensor feedback system 250 as described herein. Cooling systems 100, 1000 and sensor feedback system 250 described in FIGS. 13 and 13A may be implemented using the apparatuses, systems and methods described herein, including various embodiments thereof. As shown in FIG. 13, cooling systems 100, 1000 may include the following steps.

At least one pallet 150 containing freshly harvested produce may be inserted into the first section 200 of container 350 described herein and held in a semi-cooled environment. In an embodiment, scale 700 may then weigh at least one pallet 150 and send this weight information to computer and/or PLC, which information may then be outputted to local storage and/or cloud-based databases described herein.

At least one pallet 150 may then be conveyed via conveyor system 130 described herein to first cooling station 300*a* of second section 300 described herein. Chilled air in a temperature range of approximately 32 to 50 degrees may then be outputted onto the at least one pallet 150 to cool produce in the at least one pallet 150. In exemplary embodiments, blueberries within at the least one pallet 150 may be cooled to an optimal temperature of approximately 50 to 55 degrees.

As shown in FIG. 13A, sensor feedback system 250, including temperature sensors, may then start an RFID read process to determine temperature of produce within at least one pallet 150. In this embodiment, an RFID reader antenna may read tags inserted/placed within the at least one pallet 150 to determine current temperature of the produce within the at least one pallet 150. In other embodiments, sensor feedback system 250 may utilize a Wi-Fi connection to wirelessly and continuously communicate information regarding produce from wireless temperature sensors to a PLC mounted in container 350. In embodiments, temperature sensors may send temperature readings obtained from produce to the PLC, which PLC may then store and transmit this information locally to a computer connected to the PLC and mounted in container 350. Computer may then output this temperature reading to a web address/user interface accessible by a user of a user computing device such as for e.g., a mobile device. Computer may also output this reading to local and/or cloud-based databases.

PLC may use this information received regarding the produce to determine whether to speed up the movement of the at least one pallet 150 containing produce on the conveyor system 130 or slow it down so that the produce will be cooled for a longer time frame. Although a user may directly control the AC unit to adjust the cooling temperature, the PLC may also determine if dampers described herein mounted in the container 350 should open and close to allow more or less air flow, as well as whether inline fans located outside the container 350 should spin faster or slower and thereby increase or decrease CFMs in system 100. A user who wishes to change the temperature of the produce may monitor the webpage and turn the AC unit down or up. In an exemplary embodiment, the goal/optimal temperature may be set through the web address/user interface, and the conveyors in conveyor system 130, fans and/or dampers may be controlled by the PLC based on that goal regardless of the temperature of the AC unit.

If the temperature reading on the tags is not at an optimal level (an optimal level being, for e.g., blueberries at a temperature of approximately 50 to 55 degrees), then sensor feedback system 250 may wait a minute and repeat the process by continuing to read tags in the at least one pallet 150 via the RFID reader antenna to determine temperature of the produce. In embodiments, sensor feedback system 250 may continue to send the temperature information to local storage and/or cloud-based databases described herein.

On the other hand, if the temperature reading on the tags is at the optimal level, then the at least one pallet 150 may then be transported to second cooling station 300*b* described herein via the conveyor system 130. See FIG. 13. Chilled air in a temperature range of approximately 32 to 50 degrees may again be outputted onto the at least one pallet 150 to cool produce in the at least one pallet 150. Temperature of produce within the at least one pallet 150 in the second section 300 may then be re-determined/evaluated via the steps of the sensor feedback system 250 described herein. See FIG. 13A. Sensor feedback system 250 may then resend the temperature information to local storage and/or cloud-based databases described herein.

At least one pallet 150 may then be transported to third cooling station 300*c* described herein via the conveyor system 130. Chilled air in a temperature range of approximately 32 to 50 degrees may then be outputted onto the at least one pallet 150 to cool produce in the at least one pallet 150. Temperature of produce within the at least one pallet 150 in the third section 400 may then be re-determined/evaluated via the sensor feedback system 250 described herein. See FIG. 12A. Sensor feedback system 250 may then resend the temperature information to local storage and/or cloud-based databases described herein.

At least one pallet 150 may then be conveyed from the second section 300 onto a third section 400 via the conveyor system 130. Third section 400 may maintain the chilled produce in the at least one pallet 150 at the optimal temperature prior to unloading.

Embodiments provide a method for cooling produce. Methods may include using the cooling systems 100, 1000 described herein, including container 350, conveyor system 130, and sensor feedback system 250. In an exemplary embodiment, the method includes inserting at least one pallet 150 containing produce into the particular embodiment of cooling systems 100, 1000. In some embodiments, the weight of the at least one pallet 150 may be measured and tracked via scale 700 of sensor feedback system 250. The method includes transporting the produce in the at least one pallet 150 from the first section 200 of the container 350 to the second section 300 of the container 350 via the conveyor system 130. The method includes cooling the produce within the at least one pallet 150 to an optimal temperature via internal-external cooling mechanism 500 and/or internal cooling mechanism 600 described herein installed within the second section 300, continuously measuring and tracking the temperature of the produce within the at least one pallet 150 via the sensor feedback system 250 while the at least one pallet 150 is conveyed along the second section 300 to ensure the produce remains at the optimal temperature; and transporting the at least one pallet 150 from the second section 300 to the third section 400 via the conveyor system 130 for maintaining the produce at the optimal temperature prior to unloading.

Harvest-to-Sale Data Collection Systems

Special harvest-to-sale data collection systems 1001, 1001A will now be described. It is an objective of these systems 1001 to provide data collection and usage solutions that will increase visibility and logistical support for all players in the supply chain, including farmer, packer, marketer, wholesaler, retailer, and consumer, which increases market efficiencies. The systems are configured to use the produce data for material requirements planning (MRP), particularly in certain stages, such as packing. It is also an objective of the systems to provide enhanced data collection and presentation about the "cold chain" to all participants in the "cold chain" of produce, including consumers at the end of the process. A cold chain is a temperature-controlled supply chain. An unbroken cold chain is an uninterrupted series of refrigerated production, storage and distribution activities, along with associated equipment and logistics, which maintain a desired low-temperature range. Under conventional produce systems, available cold chain data is segregated within particular participants, such as farms, pack houses, grocery wholesalers, and grocery retailers. As a result, comprehensive cold chain data is not available to all participants. Additionally, cold chain data is not available to end consumers of the produce. It is an object of the invention to provide integrated systems that collect and provide relevant cold chain data to all market participants, including end consumers, from the point of harvest to the point of sale.

The robust real-time data collection processes described herein provide the basis for an application service provider (ASP) application specific to produce data. By collecting and uploading harvest-to-sale data into an ASP app, the system 1001, 1001A is able to control and profit from the data. Different players in the supply chain and cold chain are able to mine and parse the produce specific data to support their specific needs. For example, packers use weight and volume data to staff and supply the packing operation; marketers use other aspects of the data to advertise to and connect with potential buyers; wholesalers and grocery stores make purchase decisions based on factors such as source, produce variety, cold chain integrity, and volume; and end consumers use cold chain data to verify that they are buying a quality product.

The ASP app provides market participants with access to the data over a network, such over through a standard HTTP protocol. Different users can be provided with different levels of access through the ASP app, such as access to all or some subsets of data, access to write or to read-only, or ability to download or manipulate selected data. Pricing can be based on accessibility level, amount of usage, or other factors. The ASP app can provide specialized and powerful analytics functions to small-to-medium sized businesses that would otherwise not have access to such information. An ASP app reduces the cost of distributing software, and allows for enhanced features such as security, system wide software updates, and technical support to users.

It should be appreciated that these harvest-to-sale data collection systems 1001, 1001A can be used independently of the previously described cooling systems 100, 1000. However, as will be discussed below, the cooling systems 100, 1000 described herein can be incorporated into certain steps of the harvest-to-sale systems 1001 to enhance the quality of the produce or provide automatic data collection, and thus improve both the quality and quantity of the data used in the systems 1001.

Independent Remote Packer Model

FIG. 18 presents a schematic flow of processes in what can be referred to as an independent remote packer model system 1001. As indicated above, this system can be provided in the form of an ASP app. In the independent remote packer model 1001, produce 152 is being acquired from a third party that is not directly linked into a data collection system. As will be discussed below, the system 1001 provides means for loading produce data into the system 1001 for future use. The system 1001 saves the data to a database in the cloud 2000 for use in marketing and selling produce 152 to wholesalers, retailers and end consumers.

Figure 18A:
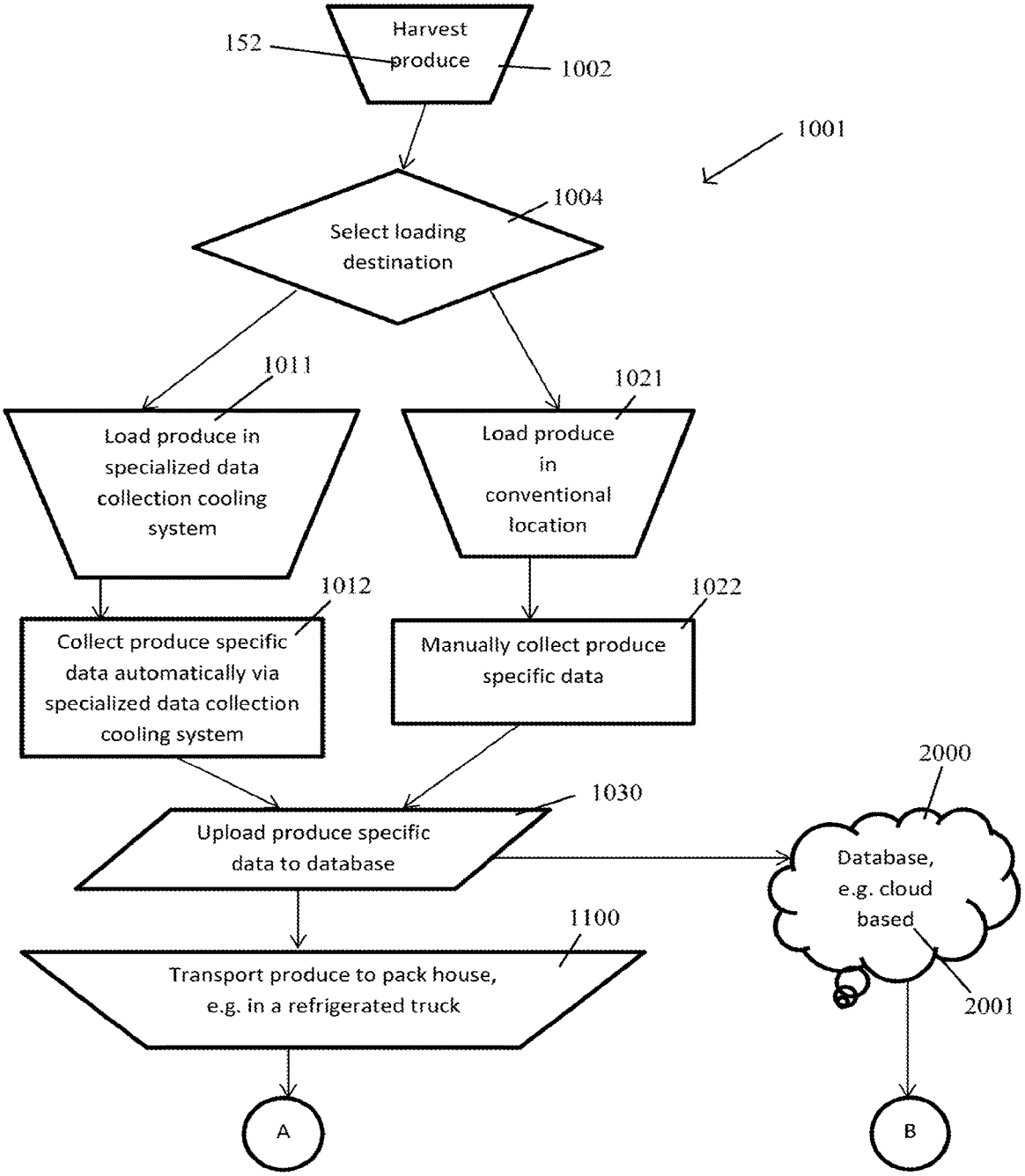
FIG. 18A-E is a flowchart of an independent remote packer model system for collecting, displaying and using produce data from harvest-to-sale.
Figure 18B:
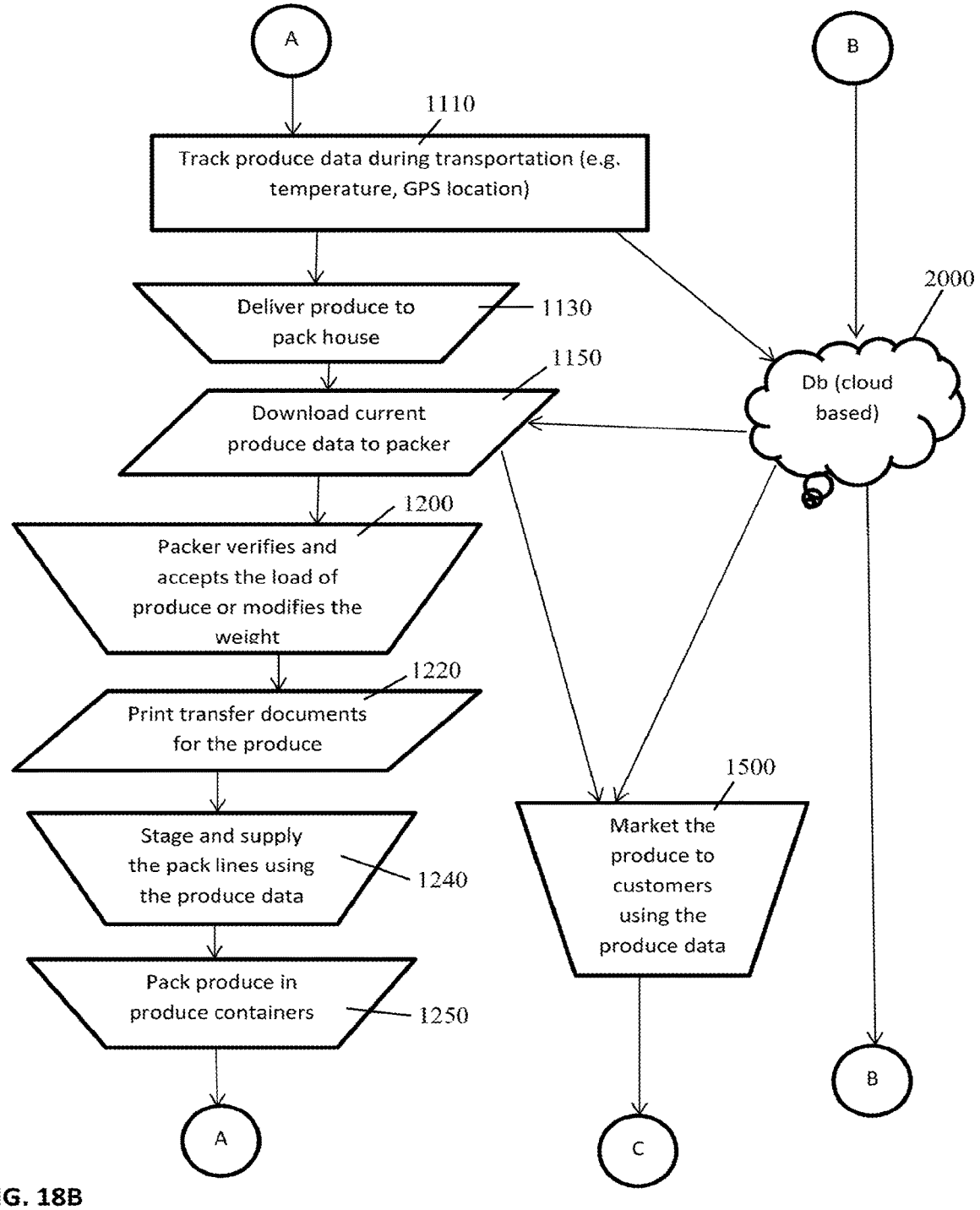

As shown in FIG. 18A, the produce 152, such as blue berries, is harvested 1002 using known harvesting methods. Once the produce 152 has been harvested, it is brought to a selected loading destination 1004. While in the loading destination 1004, initial data is collected. At this point in the process, the data is likely to consist of weight and incoming produce temperature, but other data, such as ambient air temperature, humidity, date, time of day, farm of origin, variety, field location/block location, local weather conditions, and the like could also be collected.

If the produce 152 is loaded to a conventional loading destination 1021, data about the produce is entered manually into the system 1022. Manual data entry can be done using a conventional input means on a computer or mobile device, such as a keyboard or keypad. User friendly screens and prompts can be programmed into the system. However, if the produce 152 is loaded to a specialized data collection cooling system 100, 1000, such as the mobile field cooling system described herein, the produce specific data is automatically collected by the various sensors previously described herein. The produce specific data is collected in digital form and the system 1001 is programmed to automatically pull the digital data into the system 1001, as indicated in step 1012. Hybrids of manual and automatic collection can be provided, such as options for manually selecting which data sets will be automatically pulled into the system 1001.

Data can be corrected manually in the system, such as at the pack house, where the fruit is sorted and graded, or anywhere else in the system where data updates or corrections are needed. Once the initial produce data has been collected, it is uploaded to a database 1030. While different forms of databases could be used, current technology makes a database in the cloud 2000 particularly efficient and well-suited for the system 1001. For example, system 1001 software interface in the form of a program or application ("app") for a smart phone, tablet, or other computer can be downloaded by the independent harvester. In most applications, it is anticipated that data will be made available through the Internet, such as in an interactive ASP application, as discussed above. Once the initial produce data 1030 is in the system 1001, the app interfaces with the system 1001 to upload the data 1030 to the database 2001 in the cloud 2000 for future use. While proprietary systems could be used for data collection, such as private satellite transmission, such systems are likely to be expensive and complicated compared to use of the cloud 2000. Appropriate security protections are integrated into the system 1001 to eliminate or reduce the risk of hacking and misappropriation of produce data.

Once data 1030 transmission is complete, the produce 152 is transported to a pack house 1100. Transportation will ordinarily start with a truck used to transport produce from the field, but may involve other means of transport, such as trains or boats, prior to reaching the pack house. The precise vehicle is not determinative, although the vehicle or vehicles will ideally be refrigerated. However, the system is ideally equipped to track the produce during transport to the pack house 1100, since a primary objective of the system is to track produce specific data all the way from the farm to the grocer. For example, the system 1001 ideally tracks at least the temperature of the vehicle during transport, in order to verify that produce 152 was maintained at an acceptable temperature throughout transport 1110. The system 1001 can also track location (GPS), humidity and the like 1110. Data can be time stamped so that an up-to-the-second record is available about the condition of the produce 152 at all times.

Alternatively, at step 1100, produce 152 is sometimes transported directly to the grocer in an unpackaged state for packaging, in which case the process essentially skips to step 1310, below. At other times, produce is individually packaged for the grocer at the harvest location and then sent directly to the grocer for check-in and sale, in which case the process essentially skips to step 1460. These two options are currently less widely used. When these options are used, produce specific data will ideally be collected continuously in real-time in order to preserve a full data set for the grocer and end consumer, as well as any other interested parties.

Upon arrival of the produce 152 at the pack house 1130, the data on the load of produce 152 is downloaded and "checked in" to the packer 1150. The packer verifies and accepts the load, or modifies the weight 1200 if a change is noted. The system can be configured to print out appropriate transfer documents 1220.

The data is used at this point to stage and supply the pack lines 1240. The data can help schedule the labor, the delivery, and the quantity of packing supplies at the packing location. The system can be configured to provide full-blown MRP (material planning requirements) support. Kanban and other manufacture planning tools can be incorporated into the system. The produce 152 is packed into produce containers 1250 for subsequent sale.

Optionally, the price can be set when the produce is logged-in from the field, based on historical information about yield. By setting price at the moment of harvest, the producer gains control of the market. During the harvest, pack house intake, or packing stages, the produce specific data can be used by a marketer, such as an in-house marketer or marketing agent of the pack house, to market and sell the produce 152 to potential customers 1500. At this stage, the potential customers are likely to be bulk buyers, such as wholesalers or grocery stores. By making the produce data available to potential buyers, market opportunities are expanded or created. Buyers are able to access criteria such as weight and temperature from the time of harvest, providing quantitative basis for assessing the product 152 and comparing it to other purchase options, including competitor produce for which harvest and transport data are unknown. It is anticipated that higher prices will typically be attached to higher quality harvest and transport conditions. Providing information about how much produce is in the system on a real-time basis makes the market efficient. Currently, quantity data is not widely available in the US, and is often data from the previous year, which is unreliable and thus may cause inefficient market decisions. With quantity visible in the system, the marketer can make better decisions on pricing. The system can also act as a business-to-business platform for bidding on produce, replacing or augmenting a bidding system that currently takes place predominately by phone. Additionally, all participants have access to real-time feedback. For example, by simply logging into the system 1001, a farmer will know the disposition of his crop in real-time.

Figure 18C:
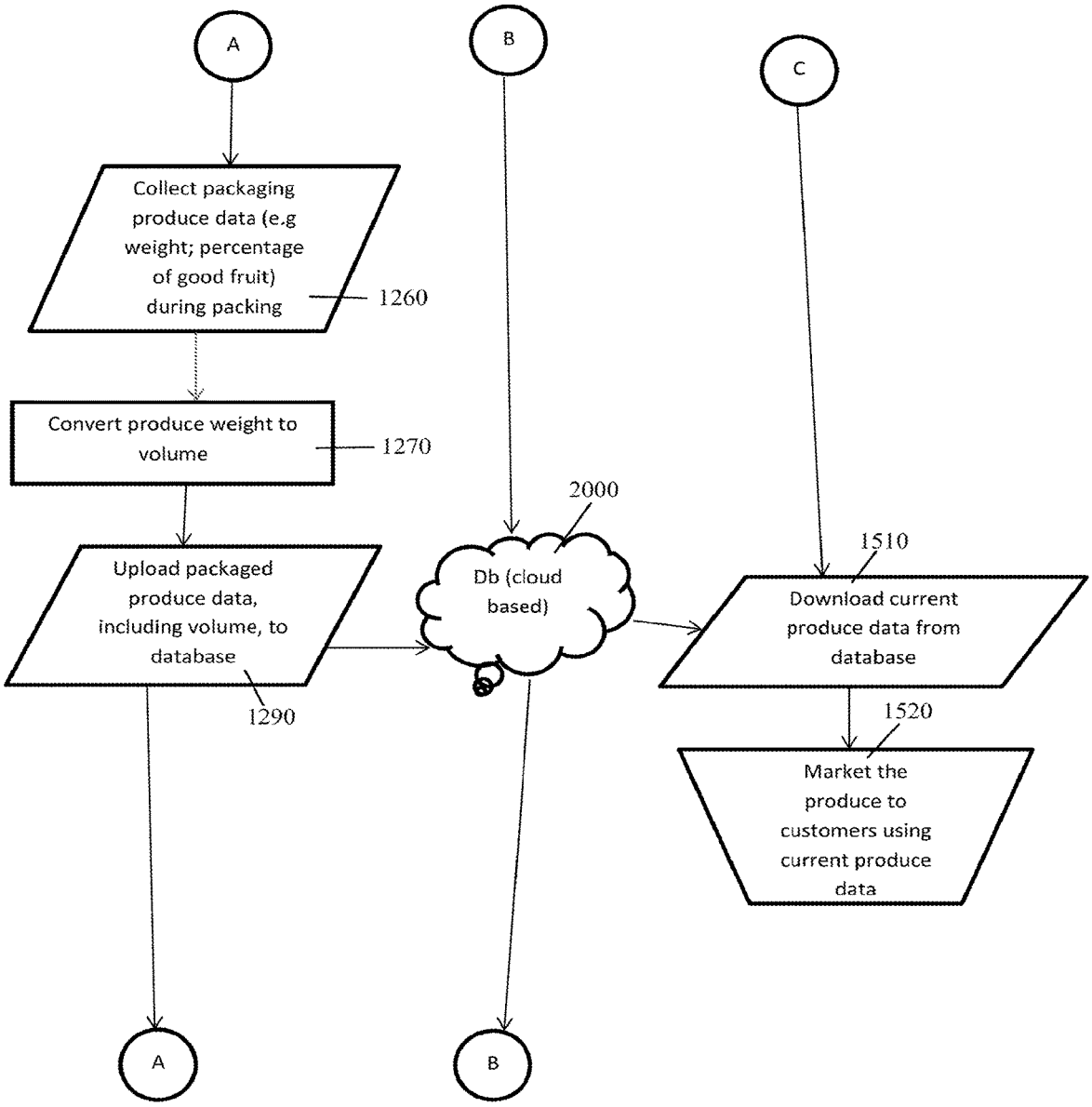

As indicated in FIG. 18C, during the process of packing the produce 152 into containers, additional data is collected 1260, such as weight and percentage of good fruit. Additionally, the system can be configured to automatically calculate produce volume based on produce weight 1270. The data is stacked in the system for use in making comparisons between data sets.

Marketers can view the current produce data 1510 from the database 2000 and use the data for marketing the produce 1520. While user interface screens of the system 1001 can take various forms and configurations, it is anticipated that product specific information will generally be provided in the form of a market maker screen, where data about many shipments can be viewed and compared in the form of sortable, searchable tables and databases. Produce volume, as calculated in step 1270, can be very useful at this stage for early marketing of the produce. The volume data provides a much earlier signal than would typically be available for demonstrating that the fruit is ready for sale. Other data can also be collected and provided to the marketer at this stage, such as place of origin, quality, and variety/strain.

Figure 18D:
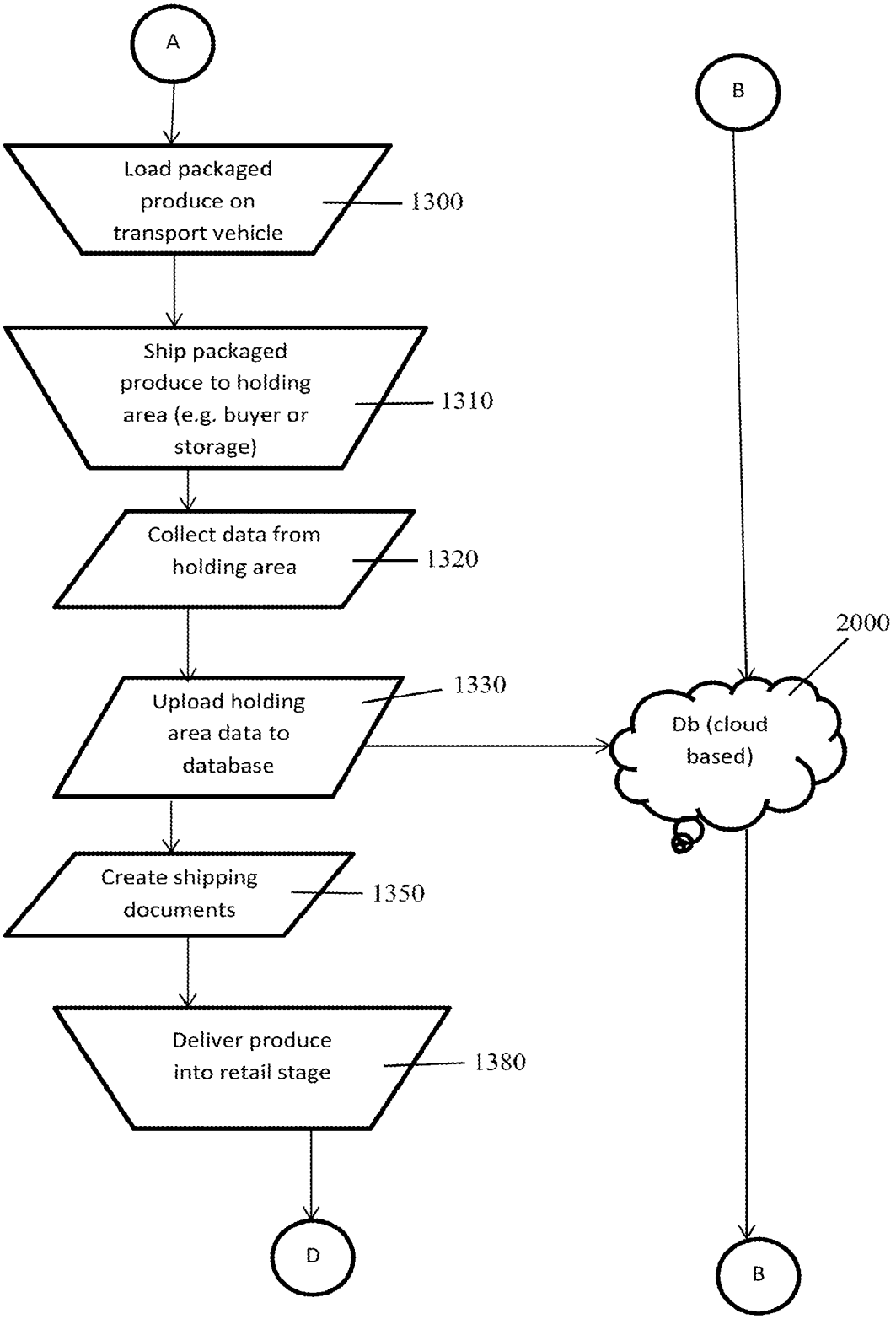

Turning to FIG. 18D, after the foregoing packaging and data processing steps, the produce is ready for delivery to a buyer, such a wholesaler or retailer, or, if a buyer has not been secured, to warehouse storage. The packaged produce is loaded on a transport vehicle 1300, such as a refrigerated truck, where data can be collected during transport as previously described. The packaged produce 152 is delivered to a holding area 1320. The system 1001 collects data in the holding area 1330. The holding area data is uploaded 1330 to the database 2000. The data will typically include at least weight and temperature, and may include positioning/GPS, humidity, time, date, identity of the party who took possession, and other useful information. The large amounts of data that are in the system provide a big data capability for users of the system, improving the efficiency of the market.

At an appropriate point during entry of produce into the retail stage, the system 1001 can be configured to create shipping documents 1350. The shipping documents can be printable or can be virtual in the system, i.e. remain in electronic and electronically accessible format. Shipping and related documentation can tie into government shipping regulators, such as the Department of Transportation. The system pulls relevant data into the shipping documents, thus eliminating manual steps.

Figure 18E:
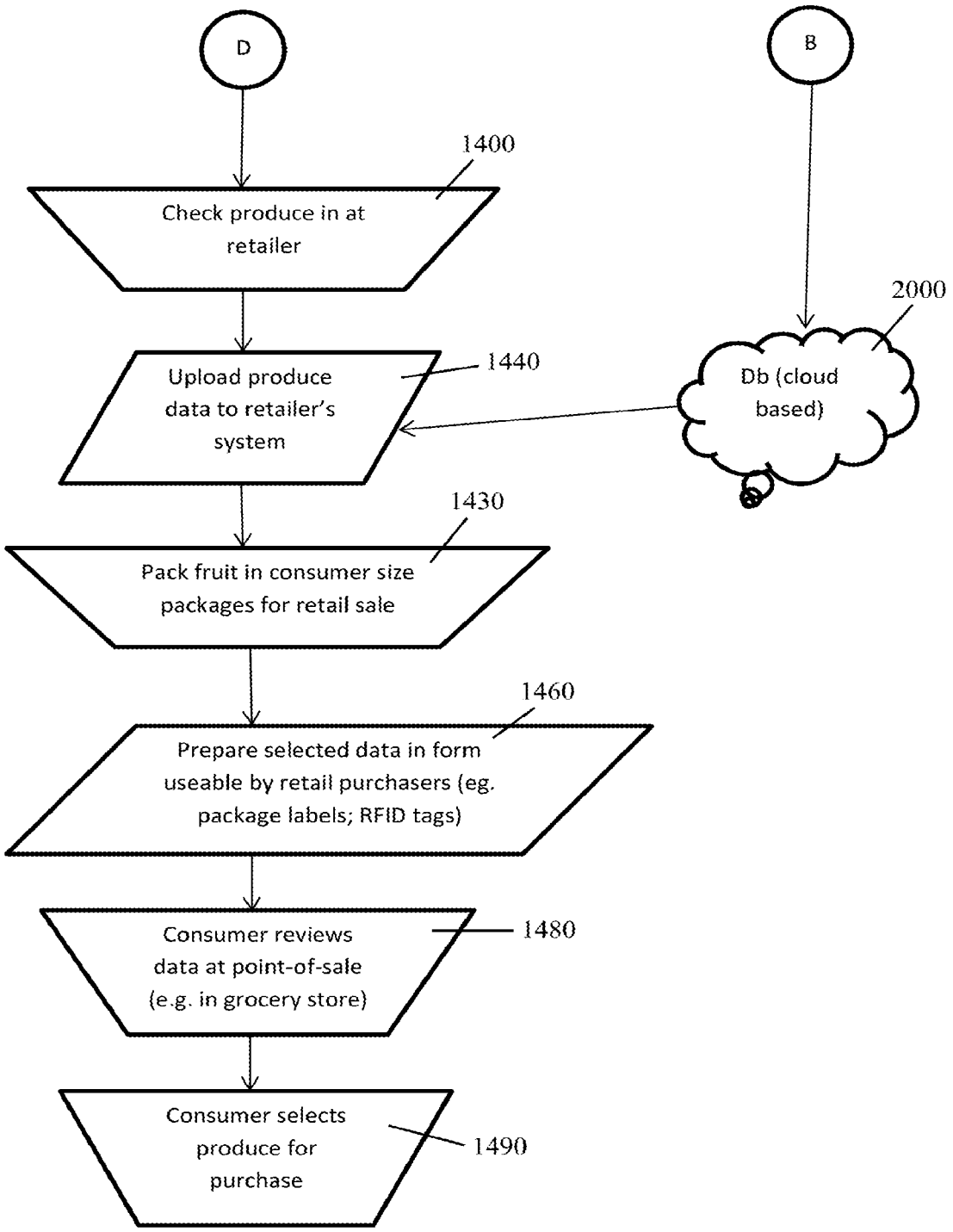

FIG. 18E summarizes steps in the retail stage of the system 1001. At this stage, the buyer is likely a grocery distribution warehouse, where the produce will be repackaged for delivery to grocery stores and individual sale to consumers. The system is configured to check the produce in at the buyer/retailer 1400, thus eliminating manual steps. After the produce is formally checked in, the system is configured to download the produce data from the database 2000 to the buyer's data system 1410, which will often be a real-time system. A large grocery wholesale will typically license specialized software from a large software provider, such as SAP. The system 1001 is configured to interact with such third-party systems in order to deliver produce data to the buyer 1410.

The produce is packed into consumer sized packages, such as private labeled packages, for retail sale 1430. The system 1001 can be configured to provide data for review by the consumer at the point-of-sale 1460. The consumer sized packages of produce are stocked in a retail store, such as a conventional grocery store. Consumers view the produce, and have the option of viewing the displayed produce data 1480. The produce data can be provided to the consumer in the form of printed material, such as labels applied to individual packaging, or in the form of a display about a segregated shipment of produce. In some embodiments, the produce data is provided in electronic format. For example, in some embodiments, the consumer uses a smart phone to scan a QR code, an RFID tag, a modifiable RFID tag, or analogous feedback means that prompts download of specific produce data to the consumer's phone. In a successful interaction, the consumer selects the product for purchase 1490.

Farm-Based Pack House Model

With reference to FIG. 19, embodiments of a farm-based pack house model system 1001A for data collection and use will now be described. As indicated above, this system can be provided in the form of an ASP app. In these models, the farm and the pack house are integrated. As such, the farm does not operate independently of the data collection system, unlike in the independent remote packer model 1001 discussed above. As will be seen, there is considerable overlap between the two systems, but the farm-based pack house model allows for the elimination of several steps found in the independent remote packer model system 1001, as well as options for internal data storage.

Figure 19A:
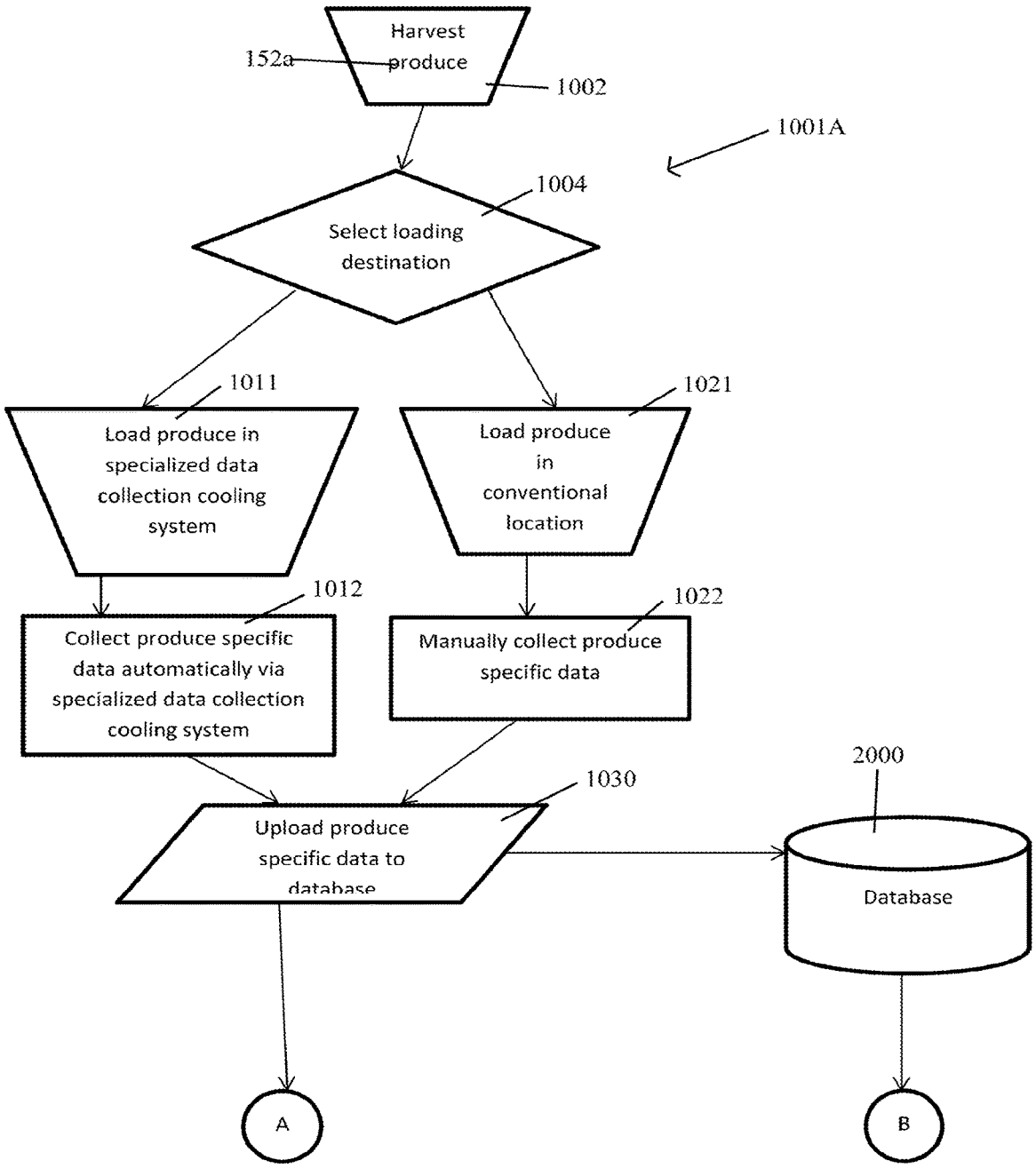
FIG. 19A-E is a flowchart of a farm-based pack house model system for collecting, displaying and using produce data from harvest-to-sale.
Figure 19B:
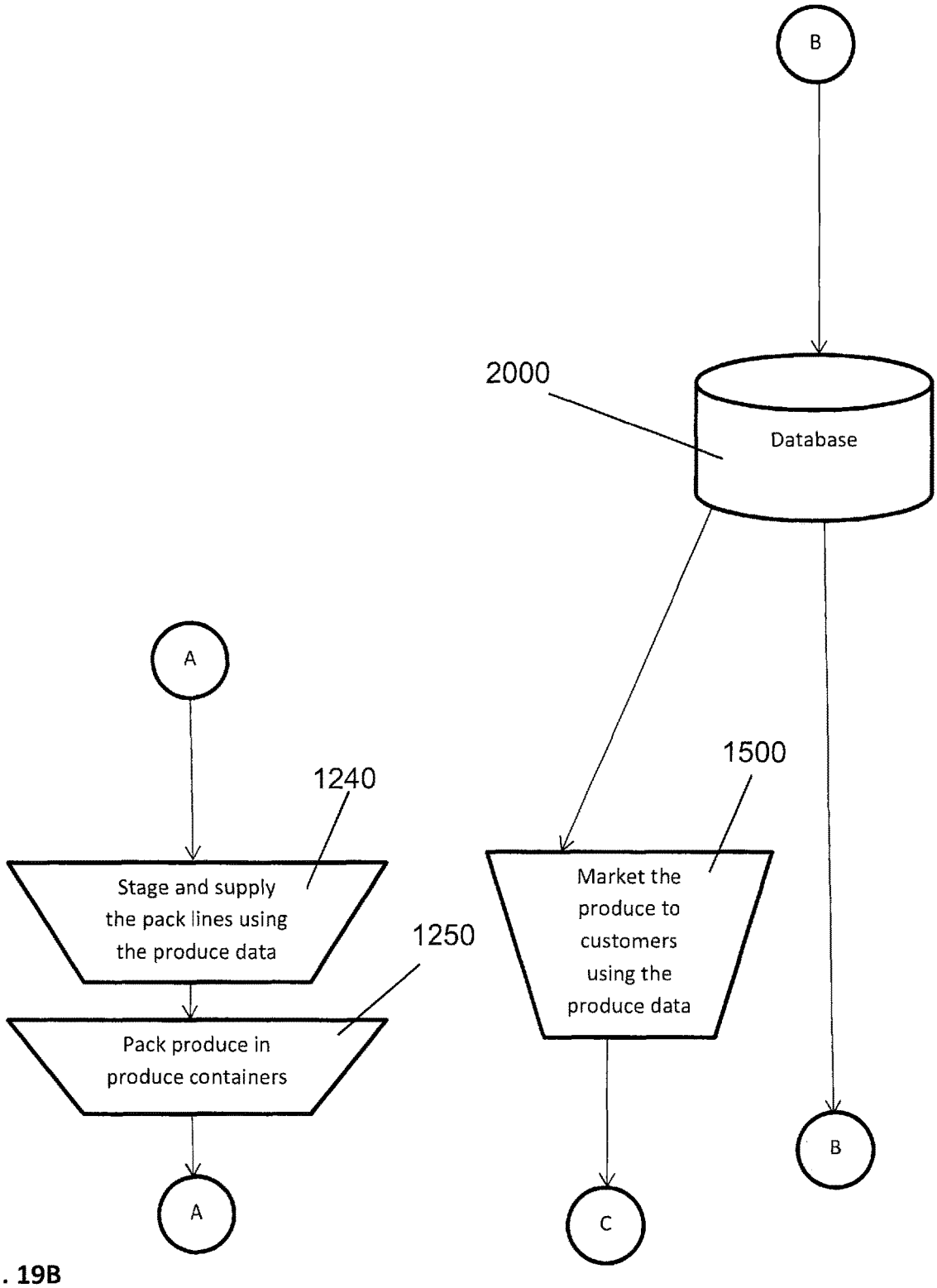

As shown in FIG. 19A, the produce 152, such as blue berries, is harvested 1002 using known harvesting methods. Once the produce 152 has been harvested, it is brought to a selected loading destination 1004. While in the loading destination 1004, initial data is collected. At this point in the process, the data is likely to consist merely of weight and incoming produce temperature, but other data, such as ambient air temperature, humidity, date, time of day, farm of origin, produce variety, field location/block location, local weather conditions, and the like could also be collected.

If the produce 152 is loaded to a conventional loading destination 1021, data about the produce is entered manually into the system 1022. Manual data entry can be done using a conventional computer or mobile device, as described above. However, if the produce 152 is loaded to a specialized data collection cooling system 100, 1000, such as the mobile field cooling system described herein, the produce data is automatically collected by the various sensors previously described herein. The produce specific data is collected in digital form and the system 1001 is programmed to automatically pull the digital data into the system 1001, as indicated in step 1012. Hybrids of manual and automatic collection can be provided, such as options for manually selecting which data sets will be automatically pulled into the system 1001.

Data can be corrected manually in the system, such as at the pack house, where the fruit is sorted and graded, or anywhere else in the system where data updates or corrections are needed. Once the initial produce data has been collected, it is uploaded to a database 1030. In FIG. 19A, the farm-based database in indicated with a generic database symbol 2000. Since data is collected and used internally in the farm-based system, use of a cloud based database is not required. For example, it might be desirable to use a proprietary in-house database 2000, such as on a stand-alone server or a server bank. Use of an in-house server enhances control of the system (for example, in troubleshooting technical difficulties and updating software), reduces system complexity by eliminating or reducing web interfaces, and can eliminate the risk of third-party hacking of data. The option of using a cloud based database 2000 remains open, depending on the preference of the users of the system 1001A. In most applications, it is anticipated that data, whether stored in the cloud or not, will be made available through the Internet, such as in an interactive ASP application, as discussed above. Optionally, produce data can be backed up for security, such as to the cloud. As with the independent packer system 1001, appropriate security protections are integrated into the system 1001A to eliminate or reduce the risk of hacking and misappropriation of produce data.

In the farm-based system 1001A, the produce is already in the possession of the farm that will carry out the packing operations, so the foregoing steps of delivery to the pack house are not used, other than transporting the produce to the packing station at or affiliated with the farm. The data is used at this point to stage and supply the pack lines 1240. The data can help schedule the labor, the delivery, and the quantity of packing supplies at the packing location. The system can be configured to provide full-blown MRP (material planning requirements) support. Kanban and other manufacture planning tools can be incorporated into the system. The produce 152 is packed into produce containers 1250 for subsequent sale.

As with the independent pack model system 1001, after step 1030, produce 152 harvested in the farm-based system 1001A is sometimes transported directly to the grocer in an unpackaged state for packaging, in which case the process essentially skips to step 1310, below. At other times, produce is individually packaged for the grocer at the harvest location and then sent directly to the grocer for check-in and sale, in which case the process essentially skips to step 1460. As noted above, these two options are currently less widely used. When these options are used, produce specific data will ideally be collected continuously in real-time in order to preserve a full data set for the grocer and end consumer, as well as any other interested parties.

As noted above, optionally, the price can be set when the produce is logged-in from the field, based on historical information about yield. By setting price at the moment of harvest, the producer gains control of the market. During the harvest or packing stage, the produce specific data can be used by a marketer, such as an in-house marketer or marketing agent of the pack house, to market and sell the produce 152 to potential customers 1500. As noted above, at this stage, the potential customers are likely to be bulk buyers, such as wholesalers or grocery stores. By making the produce data available to potential buyers, market opportunities are expanded or created. Buyers are able to access criteria such as weight and temperature from the time of harvest, providing quantitative basis for assessing the product 152 and comparing it to other purchase options, including competitor produce for which harvest and transport data are unknown. It is anticipated that higher prices will typically be attached to higher quality harvest and transport conditions. As discussed above, the system enables various market efficiencies in the marketing and sale of produce.

Figure 19C:
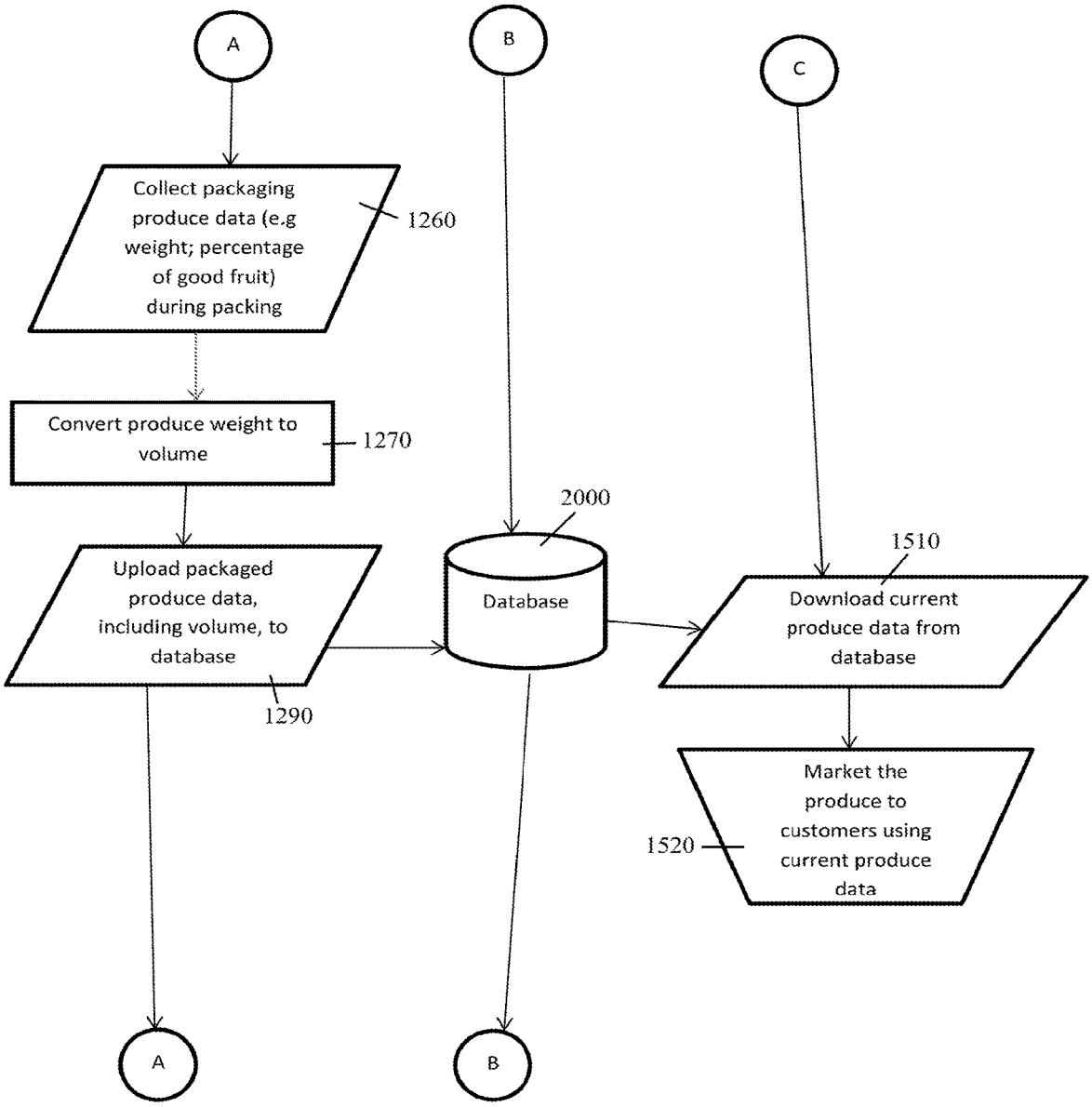

As indicated in FIG. 19C, during the process of packing the produce 152 into containers, additional data is collected 1260, such as weight and percentage of good fruit. Additionally, the system can be configured to automatically calculate produce volume based on produce weight 1270. As noted above, the data is stacked in the system.

Marketers can view the current produce data 1510 from the database 2000 and use the data for marketing the produce 1520, using interface screens and functions as described above. Produce volume, as calculated in step 1270, can be very useful at this stage for early marketing of the produce. The volume data provides a much earlier signal than would typically be available for demonstrating that the fruit is ready for sale. Other data can also be collected and provided to the marketer at this stage, such as place of origin, quality, and variety/strain.

Figure 19D:
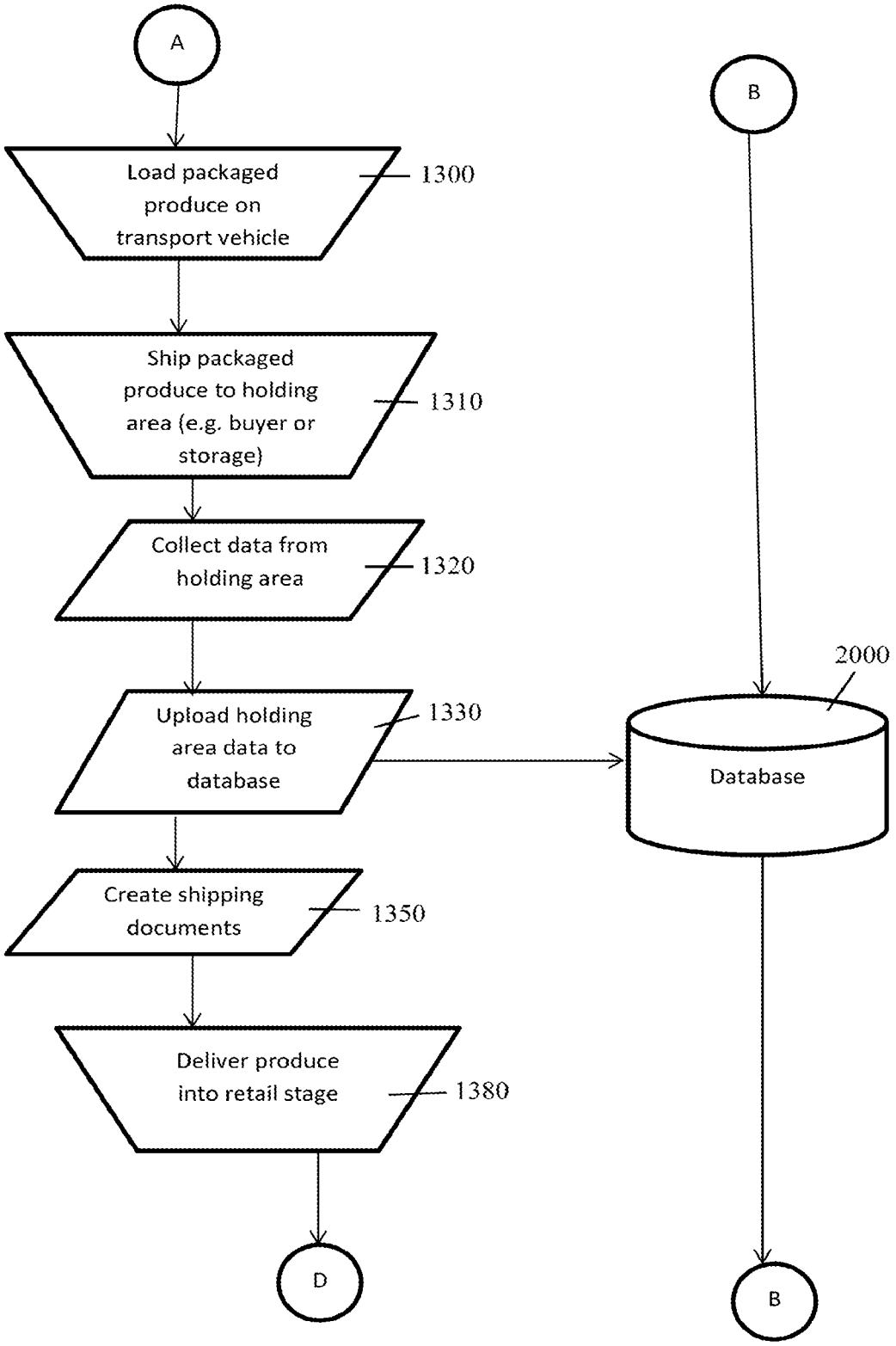

Turning to FIG. 19D, after the foregoing packaging and data processing steps, the produce is ready for delivery to a buyer, such a wholesaler or retailer, or, if a buyer has not been secured, to warehouse storage. The packaged produce is loaded on a transport vehicle 1300, such as a refrigerated truck, where data can be collected during transport as previously described. The packaged produce 152 is delivered to a holding area 1320. The system 1001A collects data in the holding area 1330. The holding area data is uploaded 1330 to the database 2000. The data will typically include at least weight and temperature, and may include positioning/GPS, humidity, time, date, identity of party who took possession, and other useful information. As noted above, the large amounts of data that are in the system provide a big data capability for users of the system, improving the efficiency of the market.

At an appropriate point during entry of produce into the retail stage, the system 1001A can be configured to create shipping documents 1350. As noted above, the shipping documents can be provided in virtual format. The system pulls relevant data into the shipping documents, thus eliminating manual steps.

Figure 19E:
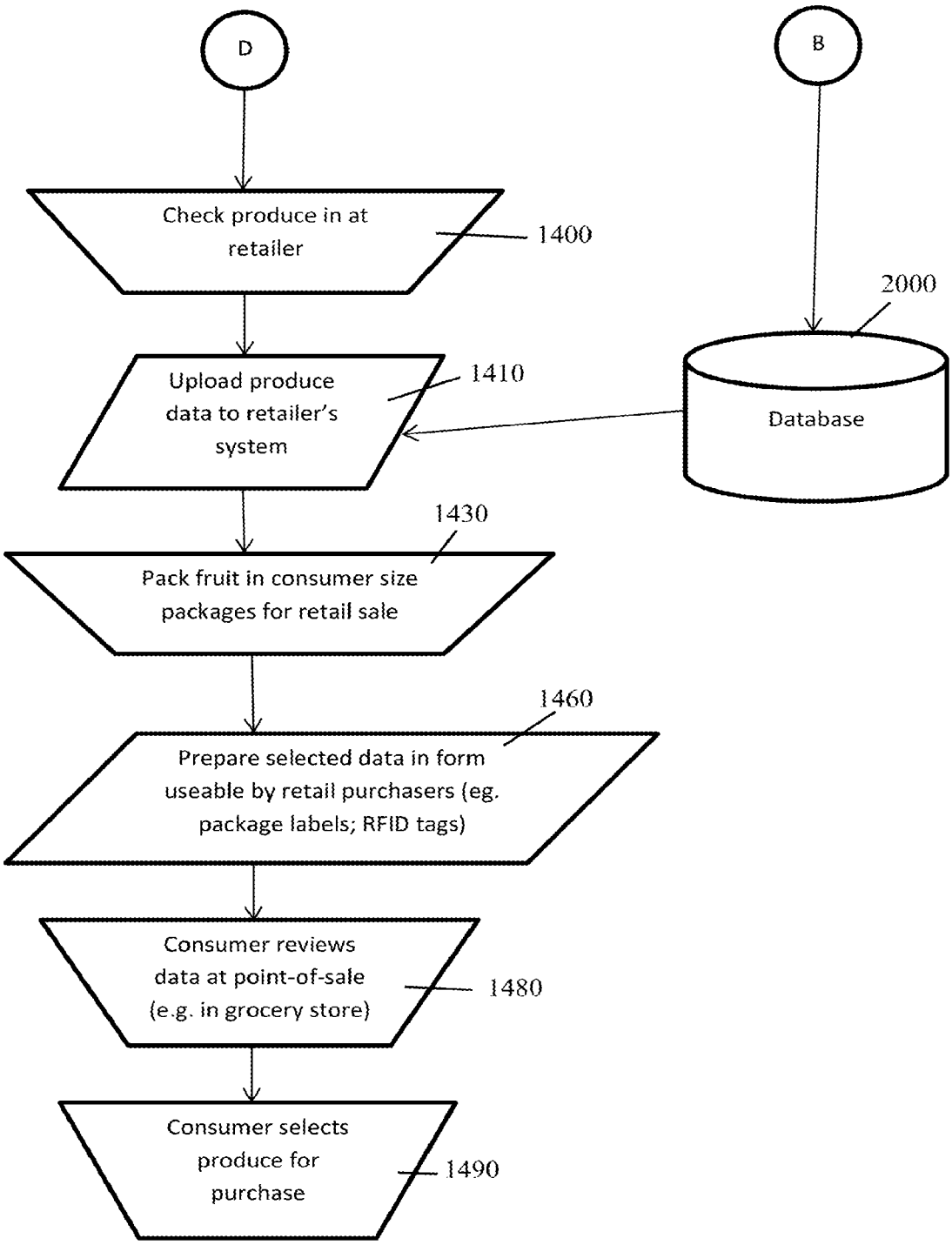

FIG. 19E summarizes steps in the retail stage of the system 1001A. At this stage, the buyer is likely a grocery distribution warehouse, where the produce will be repackaged for delivery to grocery stores and individual sale to consumers. The system is configured to check the produce in at the buyer/retailer 1400, thus eliminating manual steps. After the produce is formally checked in, the system is configured to download the produce data from the database 2000 to the buyer's data system 1410, which may be a real-time system. A large grocery wholesale will typically license specialized software from a large software provider, such as SAP. The system 1001A is configured to interact with such third-party systems in order to deliver produce data to the buyer 1410.

The produce is packed into consumer sized packages, such as private labeled packages, for retail sale 1430. The system 1001A can be configured to provide data for review by the consumer at the point-of-sale 1460. The consumer sized packages of produce are stocked in a retail store, such as a conventional grocery store. Consumers view the produce, and have the option of viewing the displayed produce data. The produce data can be provided to the consumer in the form of printed material, such as labels applied to individual packaging, or in the form of a display about a segregated shipment of produce. In some embodiments, the produce data is provided in electronic format. For example, in some embodiments, the consumer uses a smart phone to scan a QR code, an RFID tag, a modifiable RFID tag, or analogous feedback means that prompts download of specific produce data to the consumer's phone. In a successful interaction, the consumer selects the product for purchase 1490.

As noted above, it is an objective of the systems 1001, 1001A to provide enhanced data to all participants in the "cold chain" of produce, including consumers at the end of the process. Modifiable RFIDs and analogous technologies are available that both collect and transmit selected data. For example, some RFID tags have embedded thermometer software that collects temperature data. To further enhance data collection and supply, produce can be tagged with modifiable RFIDs or analogous technology when the fruit enters the system, such as at the point of harvest or at the start of the initial cool-down stage. The RFID tags collect data about the produce, such as location and the temperature, over time during the harvest-to-sale process, including the retail stage. In the retail stage, data might include produce temperatures while in the store, days since stocking in the store, origin, variety, all cold chain data (optionally in truncated form), and similar data of interest to end-purchasers. The grocer can configure the data report on the package label to meet competitive and governmental requirements. The collected data benefits all users of the system. The data tells marketers and consumers where fruit and vegetables have been and what the cold chain did to preserve freshness of the produce. For example, a smart phone can be programmed with an app that reads the produce information on a produce package in the grocery store. The produce information tells the consumer where the fruit came from, the journey it took, the players who interacted with the produce, and the history of the cold chain. Currently, for example, Groov® software can be used to display produce data provided by PLCs interfaced with sensors. By providing systems 1001, 1001A that record and display produce data about the entire cold chain of custody, consumers are assured that they are buying the freshest and longest lasting fruits and vegetables available on the market.

It will be appreciated that steps in the foregoing processes 1001, 1001A can be modified, embellished upon, performed in alternate orders, or in some cases eliminated, without deviating from the spirit and scope of the invention.

While the embodiments are described with reference to various implementations and exploitations, it will be understood that these embodiments are illustrative and that the scope of the inventions is not limited to them. Many variations, modifications, additions, and improvements are possible. Further still, any steps described herein may be carried out in any desired order, and any desired steps may be added or deleted.

What is claimed is:

1. A system, comprising:

a mobile container having an input opening on a first end and an output opening on an opposing second end thereof, the input opening and the output opening configured to receive produce containers therethrough, wherein the mobile container includes:

a cooling section having a plurality of cooling mechanisms that cool produce to a specified temperature, the plurality of cooling mechanisms including:

a first cooling mechanism that cools produce by circulating chilled air across the produce in a first direction, a second cooling mechanism that further cools the produce by circulating chilled air across the produce in a second direction that is opposite the first direction, and a sensor feedback system that continuously measures and tracks a temperature of the produce and controls movement of the produce on the conveyor system based at least on the measurement of the temperature.

2. The system of claim 1, wherein the mobile container further includes a staging section adjacent the input opening that provides a cooled environment for initial cooling of the produce.

3. The system of claim 2, wherein the mobile container further includes a discharge section positioned to receive the produce containers conveyed from the cooling section, the discharge section maintaining the produce at the specified temperature and configured to convey the produce containers out of the mobile container through the output opening.

4. The system of claim 3, further comprising a conveyor system in the mobile container for conveying the produce containers from the first end to the second end to sequentially transport the produce containers through the staging section, the cooling section, and the discharge section.

5. The system of claim 4, wherein the sensor feedback system is a dynamic real-time sensor feedback system, the sensor feedback system further configured to measure and track weight of the produce as the produce containers are conveyed through the system.

6. The system of claim 5, wherein the sensor feedback system includes a first sensor integrated with the conveyor system and used to measure weight of at least one pallet upon entering the system and a second sensor placed within the at least one pallet and used to measure the temperature of the produce within the at least one pallet.

7. The system of claim 6, wherein the first sensor and the second sensor send at least one of weight information and temperature information to a Programmable Logic Controller (PLC) device.

8. The system of claim 7, wherein the PLC device obtains at least the weight information and the temperature information of the produce and sends the weight information and the temperature information to at least one of local storage and a cloud-based database.

9. The system of claim 6, wherein the sensor feedback system includes sensors mounted within the mobile container that allow a user to determine a location of each pallet in the cooling system.

10. The system of claim 5, wherein a Programmable Logic Controller (PLC) device is connected to and controls at least one of the first cooling mechanism, the second cooling mechanism, the conveyor system, and the sensor feedback system.

11. The system of claim 1, further comprising at least one door positioned between the first cooling mechanism and the second cooling mechanism to selectively close and thereby retain cold air for circulation during cooling of the produce.

12. The system of claim 1, wherein the first cooling mechanism and the second cooling mechanism each include respective cooling fans and coils to force the respective chilled air over the produce, and respective return air ducts and fans to internally recirculate air back to the respective cooling fans and coils, and wherein the cooling fans and coils of the first cooling mechanism and the return air ducts and fans of the second cooling mechanism are located on a first side of the mobile container, and the cooling fans and coils of the second cooling mechanism and the return air ducts and fans of the first cooling mechanism are located on a second side of the mobile container.

13. A method, comprising:

inserting at least one pallet containing produce into a cooling system, wherein the cooling system includes a mobile container including a cooling section to cool the produce within the at least one pallet to a specified temperature, and wherein the cooling section includes a first cooling mechanism that cools the produce by circulating chilled air across the produce in a first direction, a second cooling mechanism that further cools the produce by circulating chilled air across the produce in a second direction that is opposite the first direction, and a sensor feedback system, the method comprising:

transporting the at least one pallet into the cooling section;

cooling the produce within the at least one pallet to the specified temperature in the cooling section;

using the sensor feedback system to continuously measure temperature of the produce and to control movement of the produce on the conveyor system based at least on the measurement of the temperature, and transporting the at least one pallet out of the cooling section.

14. The method of claim 13, wherein the mobile container further includes a staging section that holds the at least one pallet containing the produce in a semi-cooled environment, and a discharge section that maintains cooled produce in the at least one pallet at the specified temperature, wherein the cooling section is located between the first section and the third section.

15. The method of claim 13, wherein the first cooling mechanism and the second cooling mechanism each include vents located on a respective first side of the mobile container that output chilled air to cool the produce in the at least one pallet, and exhaust vents located on a respective opposing second side of the mobile container that exhaust heat from the produce.

16. The method of claim 13, wherein the first cooling mechanism and the second cooling mechanism each include respective cooling fans and coils to force the respective chilled air over the produce, and respective return air ducts and fans to internally recirculate air back to the respective cooling fans and coils, and wherein the cooling fans and coils of the first cooling mechanism and the return air ducts and fans of the second cooling mechanism are located on a first side of the mobile container, and the cooling fans and coils of the second cooling mechanism and the return air ducts and fans of the first cooling mechanism are located on a second side of the mobile container.

17. The method of claim 13, wherein the conveyor system includes at least one conveyor longitudinally extending along the length of the mobile container, the conveyor system used to convey across the cooling system; and wherein the sensor feedback system is configured to continuously measure and track a temperature of the produce within the at least one pallet as the at least one pallet is conveyed across the cooling system.

18. The method of claim 17, wherein the sensor feedback system includes a first sensor integrated with the conveyor system and used to measure weight of the at least one pallet upon entering the system and a second sensor placed within the at least one pallet and used to measure the temperature of the produce within the at least one pallet.

19. The method of claim 17, wherein the sensor feedback system includes sensors mounted within the mobile container that allow a user to determine a location of each pallet in the cooling system.

20. A system, comprising:

a mobile container including at least one cooling mechanism that continuously cools produce to a specified temperature and maintains the produce at the specified temperature;

a conveyor system that conveys the produce across the mobile container; and a sensor feedback system that continuously measures and tracks a temperature of the produce as the produce containers are conveyed across the mobile container, and controls movement of the produce on the conveyor system based at least on the measurement of the temperature.

21. The system of claim 20, wherein the cooling mechanism includes an external cooling mechanism that interacts with an internal cooling mechanism installed within the mobile container to cool the produce.

22. The system of claim 20, wherein the cooling mechanism is an entirely internal cooling mechanism installed within the mobile container.

23. A system, comprising:

a mobile container including:

an input opening on a first end of the mobile container configured to receive produce containers therethrough;

a first section having a cooled environment for initial cooling of the produce;

a second section configured to cool the produce to a specified temperature, the second section including a first cooling mechanism that cools the produce by circulating chilled air across the produce in a first direction, and a second cooling mechanism that further cools the produce by circulating chilled air across the produce in a second direction that is opposite the first direction;

a third section that maintains the produce at the specified temperature after the produce exits the second section; and an output opening on a second end of the mobile container, which is opposite the first end, configured to discharge produce containers therethrough, and a sensor feedback system that continuously measures and tracks a temperature of the produce and controls movement of the produce on the conveyor system based at least on the measurement of the temperature.

24. The system of claim 23, further comprising a conveyor system in the mobile container for conveying produce containers from the input end to the output end to thereby sequentially transport produce containers through the first section, the second section, and the third section.

25. The system of claim 23, further comprising at least one door positioned between the first cooling mechanism and the second cooling mechanism to selectively close and thereby retain cold air for circulation during cooling of the produce.

26. The system of claim 25, wherein the at least one door includes an automatic roll-up door.

27. The system of claim 23, wherein the mobile container is fixed on a wheeled trailer chassis for moving the mobile container.

28. The system of claim 23, wherein the first cooling mechanism and the second cooling mechanism each include vents located on a respective first side of the mobile container that output chilled air to cool the produce in the at least one pallet, and exhaust vents located on a respective opposing second side of the mobile container that exhaust heat from the produce.

29. The system of claim 23, wherein the first cooling mechanism and the second cooling mechanism each include respective cooling fans and coils to force the respective chilled air over the produce, and respective return air ducts and fans to internally recirculate air back to the respective cooling fans and coils, and wherein the cooling fans and coils of the first cooling mechanism and the return air ducts and fans of the second cooling mechanism are located on a first side of the mobile container, and the cooling fans and coils of the second cooling mechanism and the return air ducts and fans of the first cooling mechanism are located on a second side of the mobile container.

30. The system of claim 23, wherein the discharge section includes a cooling mechanism having vents located on opposing sides of the mobile container that circulate chilled air over the produce from the opposing sides of the mobile container.

31. The system of claim 24, wherein the conveyor system includes a plurality of conveyors extending along the first section, the second section, and the third section of the mobile container.

* * * * *